US012778314B2

(12) United States Patent
Li

(10) Patent No.: US 12,778,314 B2
(45) Date of Patent: Nov. 3, 2026

(54) LIFTABLE AND FOLDABLE CRIB

(71) Applicant: Zhongshan City Bobie Baby Product Co., Ltd., Zhongshan (CN)

(72) Inventor: Xianfa Li, Zhongshan (CN)

(73) Assignee: ZHONGSHAN CITY BOBIE BABY PRODUCT CO., LTD., Zhongshan (CN)

( * ) Notice: Subject to any disclaimer, the term of this patent is extended or adjusted under 35 U.S.C. 154(b) by 0 days.

(21) Appl. No.: 19/435,674

(22) Filed: Dec. 29, 2025

(65) Prior Publication Data

US 2026/0182751 A1 Jul. 2, 2026

(30) Foreign Application Priority Data

Dec. 28, 2024 (CN) ..... 202411956008.5
Dec. 26, 2025 (CN) ..... 202511995572.2
Dec. 26, 2025 (CN) ..... 202522783213.2

(51) Int. Cl.
*A47D 9/00* (2006.01)
*A47D 5/00* (2006.01)

(52) U.S. Cl.
CPC ..... *A47D 9/005* (2013.01); *A47D 5/00* (2013.01); *A47D 9/012* (2022.08)

(58) Field of Classification Search
CPC ..... A47D 9/005; A47D 9/012; A47D 5/00; A47D 5/006; A47D 7/002; A47D 13/061
(Continued)

(56) References Cited

U.S. PATENT DOCUMENTS 2,769,183 A * 11/1956 Froelich ..... A47D 13/065 5/177
4,811,437 A * 3/1989 Dillner ..... A47D 13/063 5/99.1
5,363,521 A * 11/1994 Garland ..... A47D 13/063 5/98.1

(Continued)

FOREIGN PATENT DOCUMENTS

CN 202005504 U 10/2011
CN 115123365 A 9/2022

(Continued)

OTHER PUBLICATIONS

Gang Li et al., Design and Development of Portable Folding Baby Bed, Applied Mechanics and Materials, Oct. 2013, pp. 65-68, vol. 443, Trans Tech Publications, Switzerland.

*Primary Examiner* — David R Hare
(74) *Attorney, Agent, or Firm* — MATTHIAS SCHOLL P.C.; Matthias Scholl

(57) ABSTRACT

A crib, including: a side frame including a first side frame and a second side frame; a guardrail assembly disposed between the first side frame and the second side frame and including a first rod and a second rod; a support assembly disposed between the first side frame and the second side frame, and including a third rod, a fourth rod, and a folding joint; a first lock assembly configured to restrict relative rotation between the first rod and the second rod; a second lock assembly configured to restrict relative rotation between the third rod and the fourth rod; and a linkage unlocking mechanism including a first operating member movably connected to the first side frame, a first traction member operatively connecting the first operating member to the first lock assembly, and a second traction member operatively connecting the first operating member to the second lock assembly.

18 Claims, 14 Drawing Sheets

(58) Field of Classification Search
USPC ..... 5/99.1
See application file for complete search history.

(56) References Cited

U.S. PATENT DOCUMENTS 6,317,907 B1 * 11/2001 Wang ..... A47D 13/063 5/98.1
7,043,779 B2 * 5/2006 Mendenhall ..... A47D 13/063 16/326
8,966,680 B2 * 3/2015 Dowd ..... A47D 13/063 5/98.1
12,102,240 B2 * 10/2024 Mao ..... A47D 7/002
12,114,778 B2 * 10/2024 Brun ..... A47D 13/066
2007/0017025 A1 * 1/2007 Myer ..... A47D 7/002 5/99.1
2013/0074257 A1 * 3/2013 Mendes ..... F16C 11/10 16/349
2013/0205496 A1 * 8/2013 Cheng ..... A47D 13/063 5/99.1
2013/0333111 A1 * 12/2013 Cheng ..... A47D 13/063 5/99.1
2014/0047639 A1 * 2/2014 Cheng ..... A47D 13/063 5/99.1
2015/0216322 A1 * 8/2015 Longenecker ..... A47D 9/005 5/99.1
2017/0290444 A1 * 10/2017 Mao ..... A47D 13/063

FOREIGN PATENT DOCUMENTS

CN 115462652 A 12/2022
CN 115462655 A 12/2022
CN 220192621 U 12/2023
CN 220713482 U 4/2024
CN 118021102 A 5/2024
CN 223286869 U 9/2025
DE 112022003189 T5 5/2024

* cited by examiner

LIFTABLE AND FOLDABLE CRIB

CROSS-REFERENCE TO RELATED APPLICATIONS

Pursuant to 35 U.S.C. § 119 and the Paris Convention Treaty, this application claims foreign priority to Chinese Patent Application No. 202411956008.5 filed Dec. 28, 2024, to Chinese Patent Application No. 202511995572.2 filed Dec. 26, 2025, and to Chinese Patent Application No. 202522783213.2 filed Dec. 26, 2025. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to the field of infant and toddler products, and more particularly, to a liftable and foldable crib.

Existing cribs commonly utilize manual unlocking mechanisms to facilitate folding or storage of the crib. However, the unlocking process typically requires a user to perform multiple discrete operations, resulting in a cumbersome and inconvenient procedure. Furthermore, to prevent infants or toddlers from climbing and tumbling out, conventional cribs are generally designed with substantial rail heights or a deep crib body profile. While such configurations enhance containment safety, they can obstruct the sightlines of a caregiver seated beside the crib, thereby impeding supervision and interaction.

Infants and toddlers require an appropriate crib depth that adapts to their different growth stages and caregiving scenarios. For example, when caring for a younger infant who requires frequent lifting, raising the mattress support height reduces how far a caregiver must bend over. Alternatively, when the mattress support is lowered close to the bottom of the crib, the structure can serve as a play yard, offering a contained, low-risk space for play and meeting the need for a combined sleep-and-play environment.

In contemporary adjustable crib designs, altering the mattress support height predominantly relies on fasteners such as screws and nuts for positioning and securement. The standard adjustment procedure involves loosening the fasteners, manually repositioning the support to the desired height, painstakingly realigning components, and subsequently retightening the fasteners. This methodology is inherently multi-step, often necessitates tools, and is generally time-consuming and labor-intensive. In scenarios requiring frequent height adjustments, such fasteners are prone to being misplaced, improperly installed, or insufficiently tightened. These shortcomings degrade the user experience and may ultimately compromise the structural integrity and safety of the crib.

SUMMARY

One object of the disclosure is to provide a crib, comprising:

a side frame comprising a first side frame and a second side frame, wherein the first side frame and the second side frame are disposed opposite to and spaced apart from each other;

a guardrail assembly disposed between the first side frame and the second side frame, the guardrail assembly comprising a first rod and a second rod, wherein a first end of the first rod is rotatably connected to the first side frame, and a first end of the second rod is rotatably connected to the second side frame;

a support assembly disposed between the first side frame and the second side frame, the support assembly comprising a third rod, a fourth rod, and a folding joint, wherein a first end of the third rod is rotatably connected to the first side frame, a first end of the fourth rod is rotatably connected to the second side frame, and a second end of the third rod and a second end of the fourth rod are rotatably connected via the folding joint;

a first lock assembly configured to restrict relative rotation between the first rod and the second rod in an unfolded state of the crib;

a second lock assembly configured to restrict relative rotation between the third rod and the fourth rod in the unfolded state of the crib; and a linkage unlocking mechanism comprising: a first operating member movably connected to the first side frame and movable relative thereto to an unlocking position; a first traction member operatively connecting the first operating member to the first lock assembly; and a second traction member operatively connecting the first operating member to the second lock assembly; wherein the first operating member, the first traction member, and the second traction member are configured such that movement of the first operating member to the unlocking position causes the first traction member and the second traction member to concurrently disengage the first lock assembly and the second lock assembly, respectively.

In a class of this embodiment, the first operating member is pivotally disposed on the first side frame; the linkage unlocking mechanism further comprises a first elastic reset member, the first elastic reset member is connected to both the first operating member and the first side frame, and the first elastic reset member is configured to reset the first operating member.

In a class of this embodiment, upon disengagement of the first lock assembly and the second lock assembly, second ends of the first rod and the second rod are configured to rotate toward the support assembly while first ends thereof move toward each other; second ends of the third rod and the fourth rod are configured to rotate toward the guardrail assembly while first ends thereof move toward each other; and the first side frame and the second side frame are configured to move toward each other.

In a class of this embodiment, the first lock assembly comprises a latch, a striker plate, and a housing; the latch is movably disposed at the second end of the first rod; the striker plate is disposed at the second end of the second rod; an end of the first traction member distal from the first operating member is connected to the latch; the second end of the first rod and the second end of the second rod are both rotatably connected to the housing; when the first lock assembly is in a locked state, the striker plate is engaged with the latch and restricts the first rod and the second rod from rotating relative to the housing; when the first traction member drives the latch to move in a direction away from the striker plate, the latch separates from the striker plate, thereby allowing the first rod and the second rod to rotate relative to the housing.

In a class of this embodiment, the first lock assembly further comprises a first folding elastic member; one end of the first folding elastic member is connected to the housing, and the other end of the first folding elastic member is connected to the first rod and/or the second rod; after the first lock assembly is unlocked, the first folding elastic member is configured to drive the second end of the first rod and/or the second end of the second rod to rotate towards the support assembly.

In a class of this embodiment, the first lock assembly further comprises a second elastic reset member; the second elastic reset member is connected to the latch and the first rod, and is configured to expand and contract along a lengthwise direction of the first rod; and the second elastic reset member is configured to drive the latch to move towards the striker plate.

In a class of this embodiment, the guardrail assembly or the support assembly comprises a reinforcement member; an end of the reinforcement member is connected to a mounting seat; the third rod is rotatably connected to the mounting seat; the second lock assembly comprises a locking member, a third elastic reset member, and a transmission assembly; the locking member is movably connected to the mounting seat; in an unfolded state of the crib, the locking member extends into the third rod under an elastic force of the third elastic reset member to restrict the third rod from rotating relative to the mounting seat; the transmission assembly is configured to, under being driven by the second traction member, move the locking member in a direction away from the third rod, thereby causing the locking member to overcome the elastic force of the third elastic reset member and move out of the third rod.

In a class of this embodiment, the reinforcement member is a hollow tube body comprising a tube wall and a first guide groove formed in one end of the tube wall, the first guide groove extending in a direction parallel to a movement direction of the locking member; the transmission assembly comprises a first transmission member and a second transmission member; the first transmission member comprises a guide hole and a second guide groove penetrating a side wall of the guide hole; an end of the locking member distal from the third rod is slidably fitted within the guide hole, and the locking member comprises a guide pin; the guide pin is inserted through the first guide groove and the second guide groove; a lengthwise direction of the second guide groove intersects with the lengthwise direction of the first guide groove; the first transmission member is telescopically disposed within the reinforcement member, such that a wall of the second guide groove is driven to push the guide pin to move along the first guide groove; the movement of the guide pin along the first guide groove drives the locking member to move out of the third rod.

In a class of this embodiment, the second transmission member is connected to the second traction member and, under being driven by the second traction member, is movable upward relative to the mounting seat in a vertical direction; a side of the second transmission member facing the first transmission member comprises an inclined surface; a portion of the first transmission member extends out from the reinforcement member and abuts against the inclined surface; when the second traction member drives the second transmission member to move relative to the mounting seat, the inclined surface pushes the first transmission member into the reinforcement member, thereby causing the first transmission member to drive the guide pin to move along the first guide groove in a direction away from the third rod.

In a class of this embodiment, the liftable and foldable crib further comprises a foldable mattress disposed on the support assembly.

In a class of this embodiment, the guardrail assembly has one end movably connected to the first side frame and another end movably connected to the second side frame, such that the guardrail assembly is slidable along a height direction of the side frames to enable its vertical adjustment.

In a class of this embodiment, one end of the support assembly is movably connected to the first side frame and the other end is movably connected to the second side frame, such that the support assembly is movable along a height direction of the side frames to allow for its vertical adjustment.

In a class of this embodiment, the crib further comprises a third lock assembly detachably connected to the reinforcement member; the reinforcement member comprises a second positioning hole; the third lock assembly comprises a second operating member, a third traction member, a pulling member, and a first adjustment seat; a first end and a second end of the third traction member are fixedly connected to the second operating member and the pulling member, respectively; the pulling member comprises a third guide groove and a positioning portion; the second operating member comprises a first housing, a second housing, and a limit box; the limit box comprises a third positioning hole; the first end of the third traction member is fixed in the second positioning hole and is slidable along the third positioning hole; the second end of the third traction member is fixed in the third guide groove; and the second support member comprises a plurality of fourth positioning holes.

In a class of this embodiment, the second operating member further comprises a third elastic reset member; the pulling member further comprises a fourth guide groove, and a fourth elastic reset member is disposed within the fourth guide groove; following a height adjustment of the support assembly, the third elastic reset member and the fourth elastic reset member are respectively configured to reset the second operating member and the pulling member to their original positions.

In a class of this embodiment, the crib further comprises a fourth lock assembly; the fourth lock assembly comprises a second adjustment seat, an elastic block, and a press member; the elastic block comprises a pressing portion; the second adjustment seat is slidably disposed on the second support member; the first rod and the second rod are fixedly connected to the second adjustment seat, respectively; the elastic block and the press member are fixedly disposed inside and outside the second adjustment seat, respectively; the pressing portion protrudes out from the second support member to be in opposing abutment with the press member.

In a class of this embodiment, an outer side of the first rod comprise a fixing base; the fixing base is configured to secure the first traction member on an outer side of the guardrail; after being led out from the guardrail, the first traction member is fixedly connected to the latch by the fixing base.

In a class of this embodiment, the latch is further provided with a receiving cavity and a fixing portion; the fixing portion extends out from the receiving cavity; the first traction member, after being led out from the guardrail, is connected to the fixing portion through the fixing base.

In a class of this embodiment, the folding joint comprises a connecting tube and a support base; the connecting tube is fixedly connected to the support base; the third rod and the fourth rod are detachably connected to the connecting tube, respectively; when the support base is lifted upward, the first end of the first rod and the first end of the second rod rotate relative to the connecting tube.

In a class of this embodiment, the crib further comprises a changing table; wherein the changing table comprises a base plate, a plurality of connecting rods, a side guard, and an outer cover; each of the connecting rods comprises a through channel and a locking portion; the side guard is fixed within the through channel; the locking portion of each connecting rod is detachably connected to the first rod and the guardrail; and the outer cover encloses the base plate, the plurality of connecting rods, and the side guard.

In a class of this embodiment, the first side frame and the second side frame are each capable of extending and contracting along a lengthwise direction thereof.

In a class of this embodiment, the guardrail assembly is detachably connected to the first side frame and the second side frame, and the support assembly is detachably connected between the first side frame and the second side frame.

For the aforementioned liftable and foldable crib, when the crib is in an unfolded state, the first lock assembly can lock the first rod and the second rod, thereby stabilizing the guardrail assembly in the unfolded configuration. Simultaneously, the second lock assembly locks the third rod and the fourth rod, securing the support assembly in the unfolded state. Together, the support assembly and the guardrail assembly maintain the stability of the crib in the unfolded state, reducing the risk of accidental folding and potential user injury. When folding of the crib is required, a simple actuation of the first operating member drives the first lock assembly to unlock via the first traction member, and concurrently drives the second lock assembly to unlock via the second traction member. This restores the foldability of both the guardrail assembly and the support assembly, enabling the crib to transition from the unfolded state to a folded state. Consequently, this unlocking mechanism is straightforward and reliable, simplifying the folding operation by eliminating the need for complex unlocking procedures.

Figure 1:
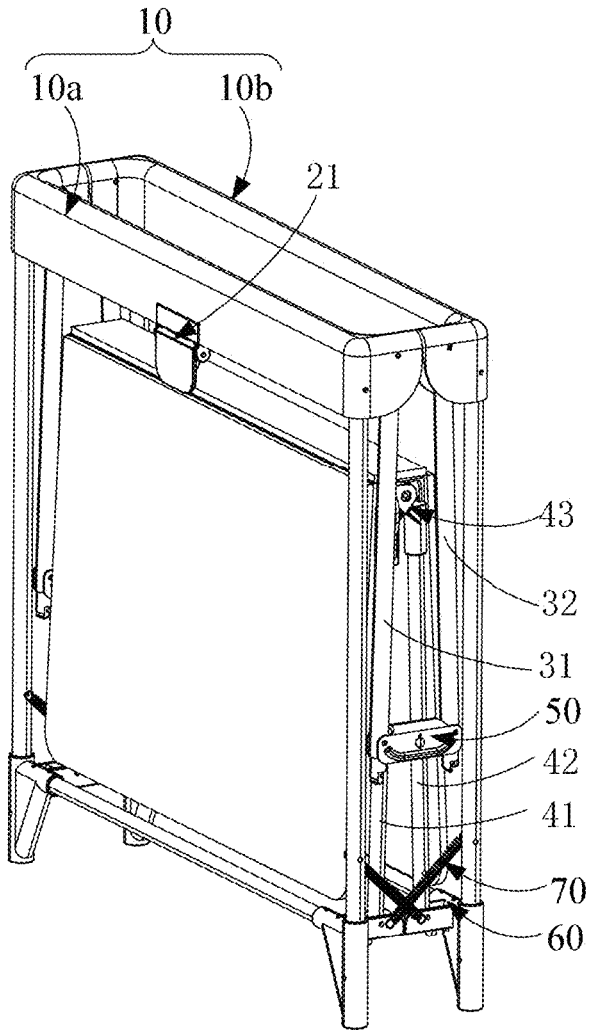
FIG. 1 is a schematic diagram of a liftable and foldable crib in a folded state according to an embodiment of the disclosure.

In the drawings, the following reference numbers are used: 10. Side frame; 10*a*. First side frame; 10*b*. Second side frame; 11. First support member; 12. Second support member; 121. Fourth positioning hole; 13. Guardrail; 131. Through hole; 14. Reinforcement member; 14*a*. First guide groove; 141. Second positioning hole; 142. Reinforcement rod; 15. Mounting seat; 16. Second operating member; 161. First operating housing; 162. Second operating housing; 163. Limit box; 1631. Third positioning hole; 17. Third traction member; 18. Pulling member; 181. Third guide groove; 182. Positioning portion; 19. First adjustment seat; 20. Linkage unlocking mechanism; 21. First operating member; 22. First traction member; 23. Second traction member; 24. First elastic reset member; 25. Slider; 26. Second adjustment seat; 27. Elastic block; 271. Pressing portion; 28. Press member; 291. Base plate; 292. Connecting rod; 293. Side guard; 30. Guardrail assembly; 31. First rod; 311. Second connection hole; 32. Second rod; 40. Support assembly; 41. Third rod; 42. Fourth rod; 43. Folding joint; 50. First lock assembly; 51. Latch; 511. Limit groove; 512. Clearance hole; 52. Striker plate; 521. Fifth connection hole; 53. Housing; 531. First clearance opening; 532. Second clearance opening; 533. Third clearance opening; 534. Fourth clearance opening; 535. First positioning hole; 536. Arc-shaped hole; 537. Insertion hole; 538. First connection hole; 539. Third connection hole; 54. Limit member; 55. Sliding member; 56. Second elastic reset member; 57. First folding elastic member; 60. Second lock assembly; 61. Locking member; 61*a*. Guide pin; 62. Third elastic reset member; 63. Transmission assembly; 631. First transmission member; 631*a*. Guide hole; 631*b*. Second guide groove; 632. Second transmission member; 632*a*. Inclined surface; 70. Second folding elastic member; 80. Mattress; 81. First pad body; 82. Second pad body; 83. Third pad body; 90. Synchronization mechanism; 91. Fifth rod; 92. Sixth rod; 93. Synchronous gear set; 931. First fixed gear; 932. First movable gear; 933. Second fixed gear; 934. Second movable gear; 100. Wheel.

DETAILED DESCRIPTION

To further illustrate the disclosure, embodiments detailing a liftable and foldable crib are described below. It should be noted that the following embodiments are intended to describe and not to limit the disclosure.

To make the above-mentioned objectives, features, and advantages of the disclosure more apparent and understandable, the specific embodiments of the disclosure are described in detail below with reference to the accompanying drawings. Many specific details are set forth in the following description to facilitate a thorough understanding of the disclosure. However, the disclosure can be implemented in many other ways different from those described herein, and those skilled in the art may make similar modifications without departing from the spirit and scope of the disclosure. Therefore, the disclosure is not limited by the specific embodiments disclosed below.

The disclosure provides a liftable and foldable crib that can be switched between an unfolded state and a folded state. In the folded state, the liftable and foldable crib has a small volume, which is beneficial for reducing occupied space and facilitates carrying and storage. In the unfolded state, the liftable and foldable crib can provide a play or sleep space for an infant or toddler.

Figure 2:
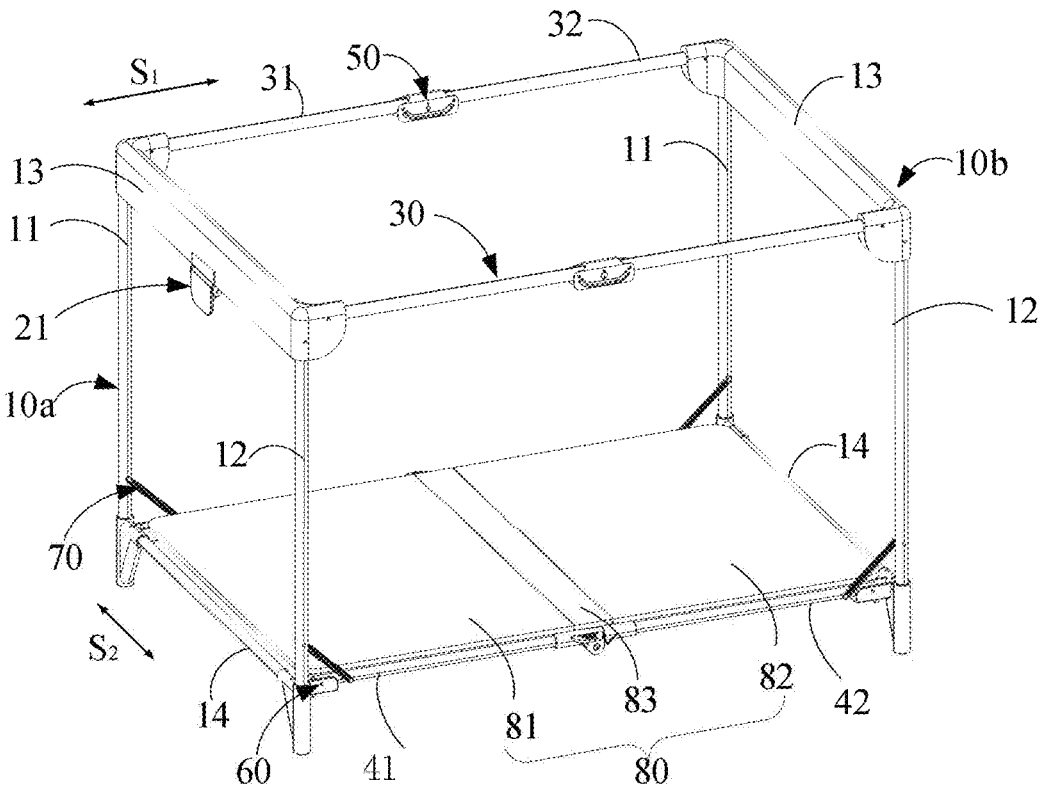
FIG. 2 is a schematic diagram of a liftable and foldable crib in an unfolded state according to an embodiment of the disclosure.

As shown in FIGS. 1 and 2, the liftable and foldable crib comprises a side frame 10, a linkage unlocking mechanism 20, a guardrail assembly 30, and a support assembly 40.

The side frame 10 comprises two units. For description, the two side frame units are respectively referred to as a "first side frame 10*a*" and a "second side frame 10*b*". The first side frame 10*a* and the second side frame 10*b* are spaced apart along a first direction, denoted as S1.

Each of the first side frame 10*a* and the second side frame 10*b* comprises a first support member 11, a second support member 12, a guardrail 13, and a reinforcement member 14.

The first support member 11 and the second support member 12 are spaced apart along a second direction, denoted as S2, and the first direction is perpendicular to the second direction. Two ends of the guardrail 13 are respectively connected to an upper portion of the first support member 11 and an upper portion of the second support member 12.

Two ends of the reinforcement member 14 are respectively connected to a lower portion of the first support member 11 and a lower portion of the second support member 12.

Optionally, the first support member 11, the second support member 12, the guardrail 13, and the reinforcement member 14 are connected to form an integrated rectangular frame. This unitary frame structure exhibits enhanced structural integrity, facilitates manufacturing processes, and imparts superior mechanical stability to the liftable and foldable crib, thereby enhancing the overall structural coherence of the product.

In another embodiment, the first support member 11 is detachably connected to the guardrail 13 and the reinforcement member 14, and the second support member 12 is detachably connected to the guardrail 13 and the reinforcement member 14. Thereby, the first side frame 10*a* and the second side frame 10*b* can be disassembled from the crib, which is beneficial for reducing the packaging volume of the liftable and foldable crib and lowering transportation costs.

The connection modes of the elements within the first side frame 10*a* and the second side frame 10*b*, as well as the structure of the guardrail assembly 30, are not limited herein. It is only required that the first side frame 10*a* and the second side frame 10*b* are capable of moving toward each other during the folding process of the liftable and foldable crib to accommodate the folding requirements thereof.

With reference to FIGS. 1 and 2, two guardrail assemblies 30 are provided. The two guardrail assemblies 30 are disposed between the first side frame 10*a* and the second side frame 10*b* and are spaced apart along the second direction S2. Understandably, both ends of each of the two guardrail assemblies 30 in the second direction S2 are connected between the first side frame 10*a* and the second side frame 10*b*.

Optionally, the guardrail assembly 30 is detachably connected to the first side frame 10*a* and the second side frame 10*b*. Thus, the liftable and foldable crib can be disassembled, which is beneficial for reducing its packaging volume and lowering transportation costs.

With reference to FIG. 1, each of the two guardrail assemblies 30 comprises a first rod 31 and a second rod 32. A first end of the first rod 31 is rotatably connected to the first side frame 10*a*, a first end of the second rod 32 is rotatably connected to the second side frame 10*b*, and a second end of the first rod 31 is rotatably connected to a second end of the second rod 32.

Optionally, the first rod 31 and the second rod 32 are hollow tubes. For example, both the first rod 31 and the second rod 32 are hollow circular tubes. This reduces the weight of the liftable and foldable crib and also lowers costs. In another embodiment, the first rod 31 and the second rod 32 may also be solid rods.

Two support assemblies 40 are provided. The two support assemblies 40 are disposed between the first side frame 10*a* and the second side frame 10*b* and are spaced apart along the second direction S2. One end of each support assembly 40 is connected to the first side frame 10*a*, and the other end is connected to the second side frame 10*b*.

Optionally, the support assembly 40 is detachably connected to the first side frame 10*a* and the second side frame 10*b*. Thus, the liftable and foldable crib can be disassembled, which is beneficial for reducing its packaging volume and lowering transportation costs.

Figure 3:
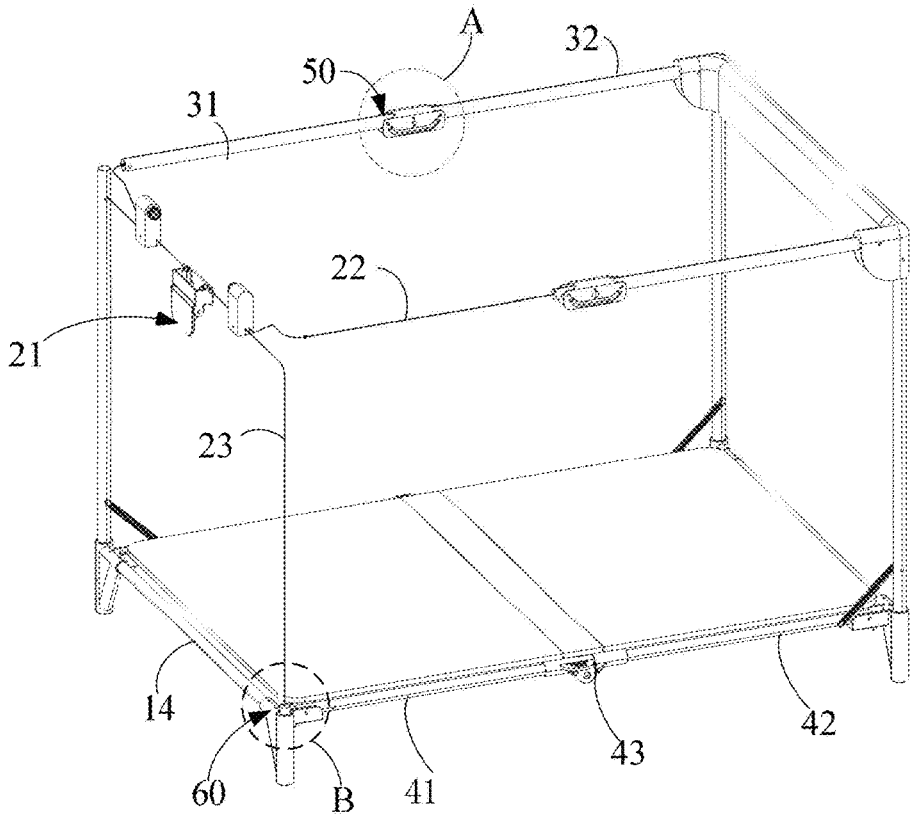
FIG. 3 is a schematic diagram of a liftable and foldable crib showing first and second traction members according to an embodiment of the disclosure.

With reference to FIG. 3, the support assembly 40 comprises a third rod 41, a fourth rod 42, and a folding joint 43. A first end of the third rod 41 is rotatably connected to the first side frame 10*a*. A first end of the fourth rod 42 is rotatably connected to the second side frame 10*b*. A second end of the third rod 41 and a second end of the fourth rod 42 are rotatably connected via the folding joint 43.

Optionally, the third rod 41 and the fourth rod 42 are hollow tubes. For example, both the third rod 41 and the fourth rod 42 are hollow circular tubes. This reduces the weight of the liftable and foldable crib and also lowers costs. In another embodiment, the third rod 41 and the fourth rod 42 may also be solid rods.

Understandably, for the liftable and foldable crib which forms a generally cubic frame structure in its unfolded state, the side frame 10 and the support assembly 40 may share structural members at their connecting portions. For instance, the reinforcement member 14 of the side frame 10 can also serve as part of the support assembly 40.

In some embodiments, the reinforcement member 14 may also be removed from the side frame 10 and is disposed as an auxiliary support member. When the support assembly 40 is disposed between the first side frame 10*a* and the second side frame 10*b*, two reinforcement members 14 are respectively disposed between the first support members 11 and between two second support members 12.

In this embodiment, both ends of the support assembly 40 may each be provided with a reinforcement member 14, and the support assembly 40 is installed to the first side frame 10*a* and the second side frame 10*b* via the reinforcement members 14 on the corresponding sides, respectively.

Furthermore, the installation height of the reinforcement members 14 at both ends of the support assembly 40 on the first side frame 10*a* and the second side frame 10*b* is adjustable, thereby enabling adjustment of the installation height of the support assembly 40.

It should be noted that the support assembly 40 can be lifted upward and lowered downward, enabling the liftable and foldable crib to achieve different functions. For example, during use, the liftable and foldable crib may be placed beside an adult bed. By lifting the support assembly 40 upward, the adult and the infant/toddler are brought to substantially the same height, facilitating care by the adult. In this scenario, the liftable and foldable crib serves to provide a resting place. In another example, by lowering the support assembly 40, the infant/toddler can play inside the crib without falling out. In this scenario, the liftable and foldable crib serves to provide a play area, functioning as a playpen.

To prevent the liftable and foldable crib from being accidentally folded during use, the liftable and foldable crib of the disclosure further possesses a locking function for securing the unfolded state and an unlocking function for releasing the lock.

For ease of understanding, the state where the liftable and foldable crib is unfolded and locked will be hereinafter referred to as a "locked state", and the state where the liftable and foldable crib is unlocked to allow folding will be referred to as an "unlocked state".

Specifically, when the liftable and foldable crib is in the locked state, the guardrail assembly 30 cannot be folded because it is locked, meaning that the rotational degree of freedom between the first rod 31 and the second rod 32 is locked. Consequently, the first rod 31 and the second rod 32 cannot rotate relative to each other. Correspondingly, when the liftable and foldable crib is in the locked state, the support assembly 40 cannot be folded because it is locked, meaning that the rotational degree of freedom between the third rod 41 and the fourth rod 42 is locked. As a result, the third rod 41 and the fourth rod 42 cannot rotate relative to each other.

In the embodiment of the disclosure, the linkage unlocking mechanism 20 can not only release the lock of the guardrail assembly 30 but also release the lock of the support assembly 40, thereby improving the efficiency of the unlocking operation.

To facilitate understanding, the structure and principle of the linkage unlocking mechanism 20 will be explained below in conjunction with the structures that achieve locking on the guardrail assembly 30 and the support assembly 40. However, this does not indicate that the structures for locking the rotational degree of freedom between the first rod 31 and the second rod 32, and for locking the rotational degree of freedom between the third rod 41 and the fourth rod 42, are limited to those described herein.

With reference to FIGS. 2 and 3, the liftable and foldable crib further comprises a first lock assembly 50 and a second lock assembly 60. When the liftable and foldable crib is in the unfolded state, the first lock assembly 50 restricts relative rotation between the first rod 31 and the second rod 32, and the second lock assembly 60 restricts relative rotation between the third rod 41 and the fourth rod 42.

It should be noted that since both the locking and unlocking of the liftable and foldable crib refer to the corresponding lock assemblies locking or releasing the crib when it is in the unfolded state, the locking of the liftable and foldable crib can be understood as the first lock assembly 50 and the second lock assembly 60 being in a locked state. Accordingly, the unlocking of the liftable and foldable crib can be understood as the first lock assembly 50 and the second lock assembly 60 being in an unlocked state.

With reference to FIG. 3, the linkage unlocking mechanism 20 comprises a first operating member 21, a first traction member 22, and a second traction member 23.

The first operating member 21 is movably connected to the side frame 10 and is capable of moving relative to the side frame 10 to an unlocking position. The first operating member 21 is operatively connected to the first lock assembly 50 via the first traction member 22 and is operatively connected to the second lock assembly 60 via the second traction member 23.

When the liftable and foldable crib is in an unfolded state, by operating the first operating member 21 to move relative to the side frame 10 to an unlocking position, the first traction member 22 and the second traction member 23 operatively cause the first lock assembly 50 and the second lock assembly 60, respectively, to release their locks. As a result, the first lock assembly 50 no longer restricts relative rotation between the first rod 31 and the second rod 32; and the second lock assembly 60 no longer restricts relative rotation between the third rod 41 and the fourth rod 42.

In this embodiment, the unlocking operation is simple. By positioning the first operating member 21 at the unlocking position relative to the side frame 10, the first lock assembly 50 and the second lock assembly 60 can be unlocked, thereby allowing the guardrail assembly 30 and the support assembly 40 to be folded.

In the embodiment of the disclosure, the first traction member 22 and the second traction member 23 are linkage ropes. In another embodiment, the first traction member 22 and the second traction member 23 may also be other flexible traction structures, which are not limited herein.

Optionally, the linkage rope comprises a steel cable and a protective sleeve. The length of the steel cable is less than the length of the protective sleeve. The steel cable is movably disposed within the protective sleeve and is capable of moving relative to the protective sleeve along its lengthwise direction.

Taking the first traction member 22 comprising a steel cable as an example, one end of the steel cable is connected to the first operating member 21, and the other end of the steel cable is connected to the first lock assembly 50. In this manner, the steel cable serves to provide linkage, and the protective sleeve serves to provide positioning.

In this embodiment, two first traction members 22 are provided. Both first traction members 22 are connected to the first operating member 21. One end of one of the first traction members 22, which is distal from the first operating member 21, is connected to one of the first lock assemblies 50. The corresponding end of the other first traction member 22 is connected to the other first lock assembly 50. In this configuration, by flipping the first operating member 21 outward, the first operating member 21 can drive both first lock assemblies 50 to actuate synchronously, thereby achieving simultaneous unlocking of the two first lock assemblies 50.

Figure 4:
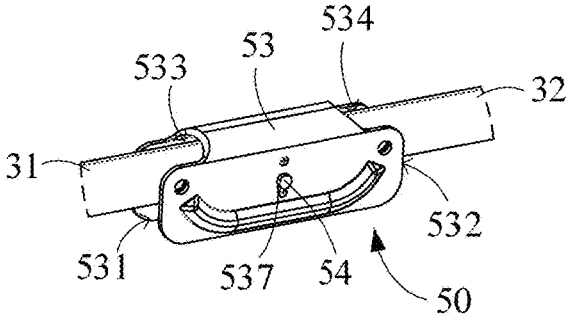
FIG. 4 is a partial enlarged view of part A in FIG. 3.
Figure 5:
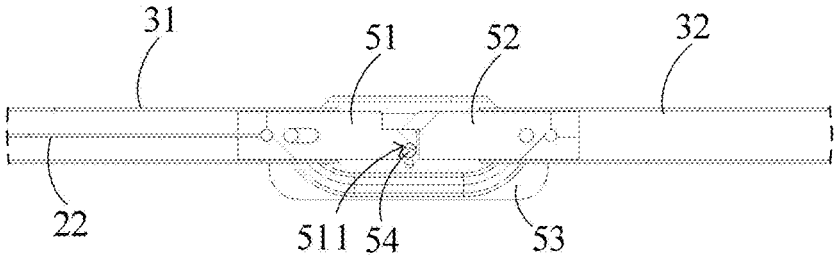
FIG. 5 is a schematic diagram of a first lock assembly of the liftable and foldable crib shown in FIG. 4.

With reference to FIGS. 4 and 5, the first lock assembly 50 is disposed between the second end of the first rod 31 and the second end of the second rod 32. The first rod 31 is rotatably connected to the second rod 32 via the first lock assembly 50.

It is understandable that both the first lock assembly 50 and the second lock assembly 60 have a locked state and an unlocked state.

With reference to FIG. 1, when both the first lock assembly 50 and the second lock assembly 60 are in the unlocked state, the first rod 31 and the second rod 32 are both capable of rotating relative to the side frame 10, and the third rod 41 and the fourth rod 42 are both capable of rotating relative to the side frame 10, thereby allowing the liftable and foldable crib to be folded and collapsed.

With reference to FIG. 2, when the first lock assembly 50 is in the locked state, the first rod 31 and the second rod 32 are coaxially disposed, and both the third rod 41 and the fourth rod 42 are fixed relative to the side frame 10. When the second lock assembly 60 is in the locked state, the third rod 41 and the fourth rod 42 are coaxially disposed, and both the third rod 41 and the fourth rod 42 are fixed relative to the side frame 10.

With reference to FIGS. 2 and 3, two first lock assemblies 50 are provided. One of the first lock assemblies 50 is disposed at the second end of one of the first rods 31 and the second end of its corresponding second rod 32. The other first lock assembly 50 is disposed at the second end of the other first rod 31 and the second end of its corresponding second rod 32.

The first operating member 21 is an unlocking handle, thereby allowing a rotational operation for unlocking. For example, the first operating member 21 is pivotally installed on the side frame 10. Optionally, the first operating member 21 is pivotally disposed on the guardrail 13.

Optionally, the first operating member 21 is pivotally disposed on a side of the first side frame 10*a* that faces away from the second side frame 10*b*. During unlocking, the first operating member 21 flips in a direction away from the second side frame 10*b*, facilitating operation.

By utilizing a rotational operation of the first operating member 21 relative to the side frame 10, the first traction member 22 causes the first lock assembly 50 to switch from the locked state to the unlocked state. Correspondingly, the rotational operation of the first operating member 21 relative to the side frame 10 can also, via the second traction member 23, cause the second lock assembly 60 to switch from the locked state to the unlocked state.

In some embodiments, the first operating member 21 can be rotated outward relative to the side frame 10 to the unlocking position. In this embodiment, to collapse the liftable and foldable crib, by flipping the first operating member 21 outward, the first operating member 21 can, via the first traction member 22 and the second traction member 23 respectively, drive the first lock assembly 50 and the second lock assembly 60 to perform an unlocking action, thereby switching the first lock assembly 50 and the second lock assembly 60 from the locked state to the unlocked state.

With reference to FIGS. 4 and 5, the first lock assembly 50 comprises a latch 51, a striker plate 52, and a housing 53. The latch 51 is movably disposed at the second end of the first rod 31. The striker plate 52 is disposed at the second end of the second rod 32. An end of the first traction member 22 distal from the first operating member 21 is connected to the latch 51. That is to say, one end of the first traction member 22 is connected to the first operating member 21 and the other end is connected to the latch 51, such that movement of the first operating member 21 can pull the latch 51 via the first traction member 22 to perform an unlocking operation. In this embodiment, the second end of the first rod 31 and the second end of the second rod 32 are both rotatably connected to the housing 53.

With reference to FIGS. 4 and 5, in the locked state, the striker plate 52 is engaged with the latch 51 and restricts the first rod 31 and the second rod 32 from rotating relative to the housing 53, thereby maintaining the guardrail assembly 30 in the unfolded state and preventing folding. When the first traction member 22 drives the latch 51 to move in a direction away from the striker plate 52, the latch 51 separates from the striker plate 52. This causes the first lock assembly 50 to transition from the locked state to the unlocked state, allowing the first rod 31 and the second rod 32 to rotate relative to the housing 53.

Furthermore, the housing 53 comprises an insertion hole 537. The first lock assembly 50 further comprises a limit member 54. The limit member 54 is inserted into the insertion hole 537, thereby connecting the limit member 54 to the housing 53. The latch 51 comprises a limit groove 511.

In the locked state, the limit member 54 engages with the limit groove 511 in a limiting fit. This prevents the latch 51 from easily retracting into the first rod 31 due to potential slight rotations of the first rod 31 and the second rod 32, thereby enhancing the stability in the locked state. The cooperation between the limit groove 511 of the latch 51 and the limit member 54 prevents the latch 51 from rotating with the first rod 31 relative to the housing 53, thereby achieving the purpose of locking the rotational degree of freedom of the first rod 31. When performing an unlocking operation on the first lock assembly 50, the first operating member 21 pulls the latch 51 via the first traction member 22, causing the latch 51 to retract into the first rod 31. At this point, the latch 51 moves away from the limit member 54. When the latch 51 retracts into the first rod 31 by a certain distance, the limit member 54 disengages from the limit groove 511. That is, the limit member 54 and the limit groove 511 disengage from their limiting fit, and the limit member 54 no longer restricts the rotation of the latch 51. Consequently, the first rod 31 can rotate relative to the housing 53.

With reference to FIGS. 4 and 5, a side of the housing 53 facing the first side frame 10*a* comprises a first clearance opening 531. A side of the housing 53 facing the second side frame 10*b* comprises a second clearance opening 532. A side of the housing 53 facing away from the support assembly 40 comprises a third clearance opening 533 in communication with the first clearance opening 531 and a fourth clearance opening 534 in communication with the second clearance opening 532.

During the assembly process of the liftable and foldable crib, the second end of the first rod 31 is disposed within the housing 53 through the first clearance opening 531, and the second end of the second rod 32 is disposed within the housing 53 through the second clearance opening 532. In this way, the first clearance opening 531 and the second clearance opening 532 serve to provide clearance, thereby facilitating the connection of the first rod 31 and the second rod 32 to the housing 53.

When the liftable and foldable crib is being collapsed, and with reference to FIG. 1, the second end of the first rod 31 rotates downward. During this rotation, the second end of the first rod 31 moves from the first clearance opening 531 to the third clearance opening 533. Simultaneously, the second end of the second rod 32 rotates downward. During its rotation, the second end of the second rod 32 moves from the second clearance opening 532 to the fourth clearance opening 534. After the liftable and foldable crib is fully collapsed, the first rod 31 is disposed at the third clearance opening 533, and the second rod 32 is disposed at the fourth clearance opening 534. In this manner, the third clearance opening 533 and the fourth clearance opening 534 serve to provide clearance, preventing the housing 53 from causing interference with the collapsing of the guardrail assembly 30.

In some embodiments, the second lock assembly 60 may adopt the same structure as the first lock assembly 50, provided that the second lock assembly 60 can meet the requirements for locking and unlocking the rotational degree of freedom of the third rod 41 and the fourth rod 42. In this embodiment, since the first lock assembly 50 and the second lock assembly 60 employ the same structure, it is beneficial for standardizing structural components and facilitates reducing replacement costs for components.

In other embodiments, the second lock assembly 60 may adopt a structure different from that of the first lock assembly 50.

Figure 6:
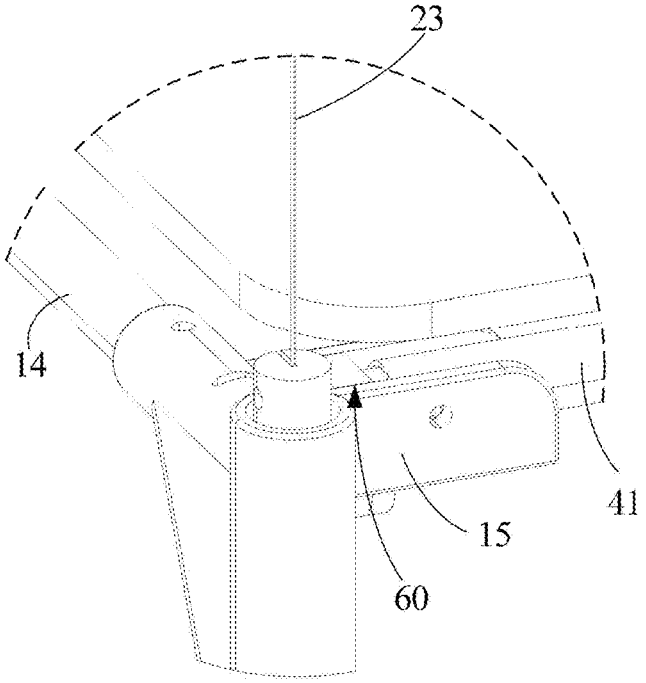
FIG. 6 is a partial enlarged view of part B in FIG. 3.

For example, with reference to FIGS. 4 and 6, an end of the reinforcement member 14 is connected to a mounting seat 15. The third rod 41 is rotatably connected to the mounting seat 15. In this manner, the reinforcement member 14 is connected to the third rod 41 via the mounting seat 15.

Figure 7:
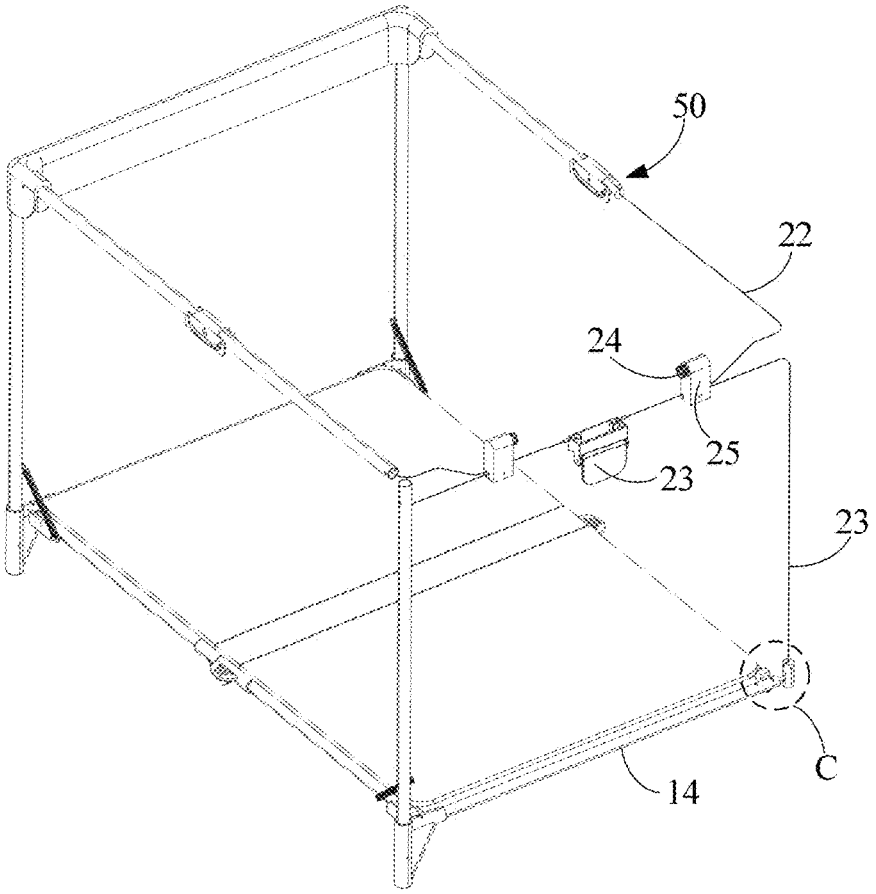
FIG. 7 is a schematic diagram of a liftable and foldable crib showing first and second traction members, from another perspective, according to an embodiment of the disclosure.
Figure 8:
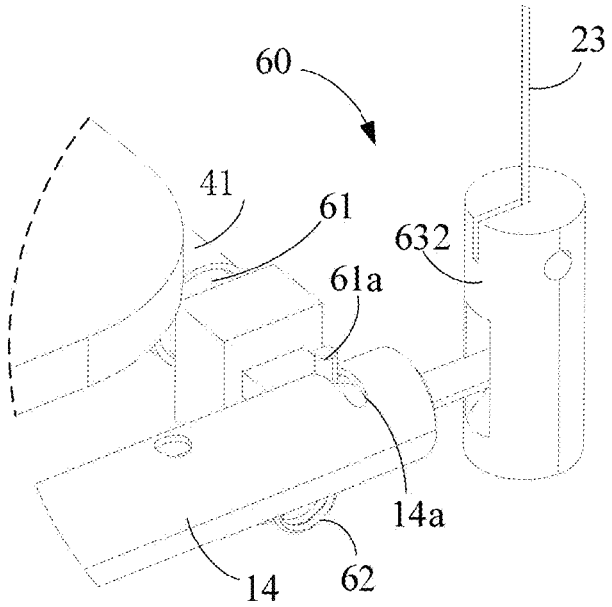
FIG. 8 is a partial enlarged view of part C in FIG. 7.
Figure 9:
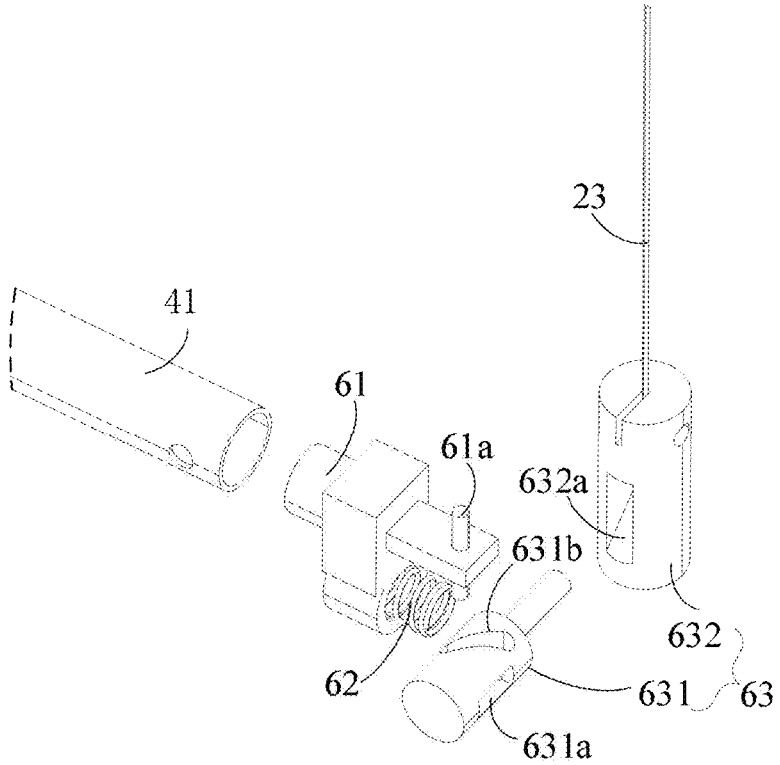
FIG. 9 is an exploded view of a second lock assembly of the liftable and foldable crib shown in FIG. 8.

With reference to FIGS. 7 to 9, the second lock assembly 60 comprises a locking member 61, a third elastic reset member 62, and a transmission assembly 63. The locking member 61 is movably connected to the mounting seat 15. This movable connection includes, but is not limited to, the locking member 61 being directly movably connected to the mounting seat 15. In some embodiments, the locking member 61 may also be movably connected to the reinforcement member 14. Consequently, when the end of the reinforcement member 14 is connected to the mounting seat 15, the locking member 61 is movably connected to the mounting seat 15.

When the liftable and foldable crib is in the unfolded state, the locking member 61 is capable of extending into the third rod 41 under the elastic force of the third elastic reset member 62, thereby restricting the third rod 41 from rotating relative to the mounting seat 15. Consequently, the third rod 41 also cannot rotate relative to the fourth rod 42, achieving the effect of locking the rotational degree of freedom of the third rod 41 and the fourth rod 42.

The transmission assembly 63 is configured to, when driven by the second traction member 23, move the locking member 61 in a direction away from the third rod 41. This causes the locking member 61 to overcome the elastic force of the third elastic reset member 62 and move out of the third rod 41. In this manner, the locking member 61 releases the lock on the third rod 41, restoring the rotational degree of freedom of the third rod 41 relative to the mounting seat 15, thereby allowing the support assembly 40 to be folded.

With reference to FIG. 8, in some embodiments, the reinforcement member 14 is a hollow tube body. The tube wall near an end thereof comprises a first guide groove 14*a*. The lengthwise direction of the first guide groove 14*a* is the same as the movement direction of the locking member 61, i.e., the same as the extension direction of the third rod 41.

With reference to FIGS. 8 and 9, the transmission assembly 63 comprises a first transmission member 631 and a second transmission member 632. The first transmission member 631 comprises a guide hole 631*a* and a second guide groove 631*b* penetrating a side wall of the guide hole 631*a*. An end of the locking member 61 distal from the third rod 41 is slidably fitted within the guide hole 631*a*, and the locking member 61 comprises a guide pin 61*a*.

The guide pin 61*a* is inserted through the first guide groove 14*a* and the second guide groove 631*b*. The lengthwise direction of the second guide groove 631*b* intersects with the lengthwise direction of the first guide groove 14*a*. The first transmission member 631 is telescopically disposed within the reinforcement member 14, such that the wall of the second guide groove 631*b* is driven to push the guide pin 61*a* to move along the first guide groove 14*a*.

The movement of the guide pin 61*a* along the first guide groove 14*a* drives the locking member 61 to move out of the third rod 41. Subsequently, the locking member 61 releases the lock on the third rod 41, restoring the rotational degree of freedom of the third rod 41 relative to the mounting seat 15, thereby allowing the support assembly 40 to be folded.

It should be noted here that the second transmission member 632 only needs to be capable of transmitting power to the first transmission member 631 under the drive of the second traction member 23, thereby causing the first transmission member 631 to drive the guide pin 61*a* to move along the first guide groove 14*a* in a direction away from the third rod 41.

For example, with reference to FIGS. 7 to 9, the second transmission member 632 is connected to the second traction member 23 and, under the drive of the second traction member 23, is movable upward relative to the mounting seat 15 in a vertical direction. A side of the second transmission member 632 facing the first transmission member 631 comprises an inclined surface 632*a*. A portion of the first transmission member 631 extends out from the reinforcement member 14 and abuts against the inclined surface 632*a*.

When the second traction member 23 drives the second transmission member 632 to move relative to the mounting seat 15, the inclined surface 632*a* of the second transmission member 632 pushes the first transmission member 631 into the reinforcement member 14. This causes the first transmission member 631 to drive the guide pin 61*a* to move along the first guide groove 14*a* in a direction away from the third rod 41. Consequently, the guide pin 61*a* moves along the first guide groove 14*a* and drives the locking member 61 to move out of the third rod 41, thereby releasing the lock on the third rod 41 by the locking member 61.

An elastic member may be disposed within the side frame 10 and configured to provide a resetting action for the first operating member 21. This configuration allows the first operating member 21 to automatically return inward relative to the side frame 10 from the unlocking position once a user releases it, thereby preventing the first operating member 21 from protruding excessively beyond the side frame 10, which could impair aesthetics or make it susceptible to snagging.

Figure 10:
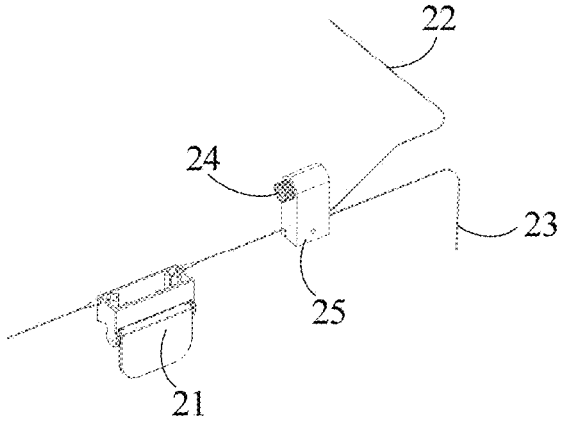
FIG. 10 is a partial schematic diagram of a linkage unlocking mechanism in a liftable and foldable crib according to an embodiment of the disclosure.

For example, with reference to FIG. 7 and FIG. 10, the linkage unlocking mechanism 20 further comprises a first elastic reset member 24. The first elastic reset member 24 is connected to the first operating member 21 and the first side frame 10*a*. The first elastic reset member 24 is configured to drive the first operating member 21 to reset.

It should be noted that the first elastic reset member 24 is directly connected to the first operating member 21, or is connected to the first operating member 21 via other structural components, as long as the first elastic reset member can achieve the reset movement of the first operating member 21. For example, with reference to FIG. 10, the linkage unlocking mechanism 20 further comprises a slider 25. The slider 25 is disposed on the first side frame 10*a* and is capable of sliding under the driving of the first operating member 21. In this embodiment, the first elastic reset member 24 is connected to the slider 25 and, by urging the slider 25 to slide relative to the first side frame 10*a*, causes the slider 25 to drive the first operating member 21 to perform the reset movement. Both the first traction member 22 and the second traction member 23 are fixedly connected to the slider 25. In this way, when the first operating member 21 is operated for unlocking, it can drive the slider 25 to move while simultaneously causing the first traction member 22 and the second traction member 23 to perform unlocking actions on the first lock assembly 50 and the second lock assembly 60, respectively.

In an embodiment where the first operating member 21 is pivotally mounted on the side frame 10, the first elastic reset member 24 may be a torsion spring. For example, one end of the torsion spring is connected to the first operating member 21, and the other end is connected to the first side frame 10*a*.

During unlocking, an external force is applied to the first operating member 21, causing it to pivot away from the second side frame 10*b*. This results in elastic deformation of the first elastic reset member 24. Once the unlocking is complete and the external force on the first operating member 21 is removed, the first elastic reset member 24 returns to its original shape, thereby driving the first operating member 21 to pivot in the opposite direction and effect its reset.

Figure 11:
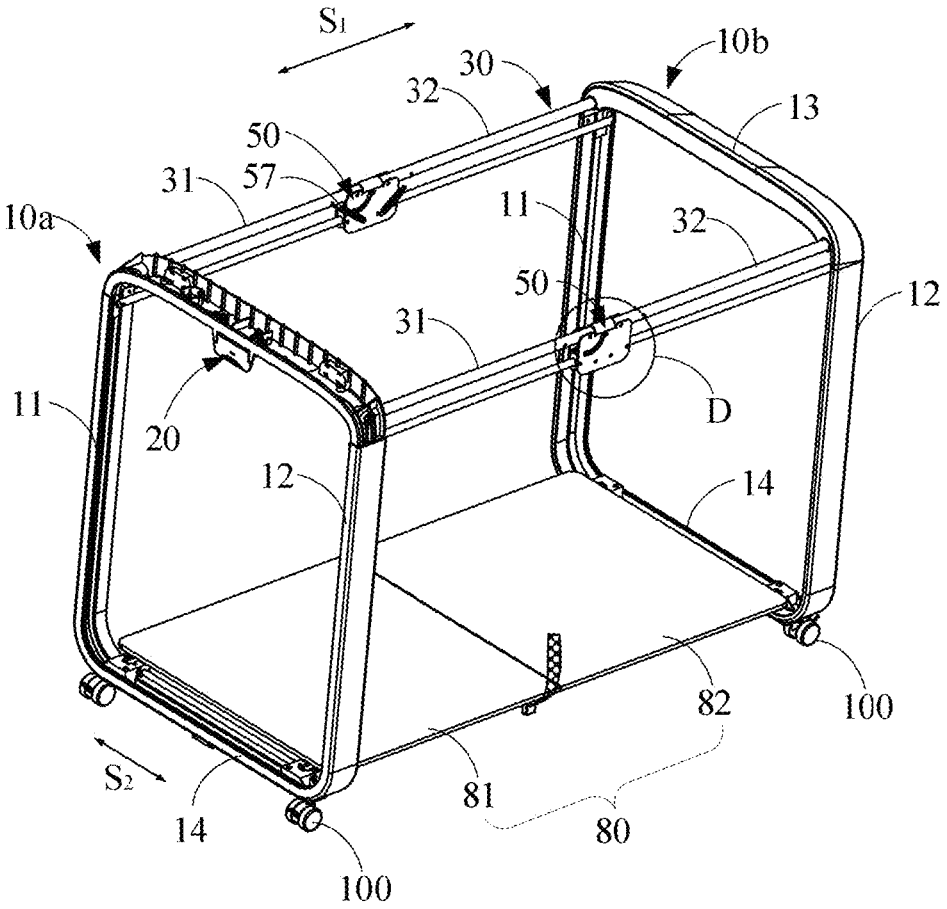
FIG. 11 is a schematic diagram of a liftable and foldable crib in an unfolded state according to another embodiment of the disclosure.
Figure 12:
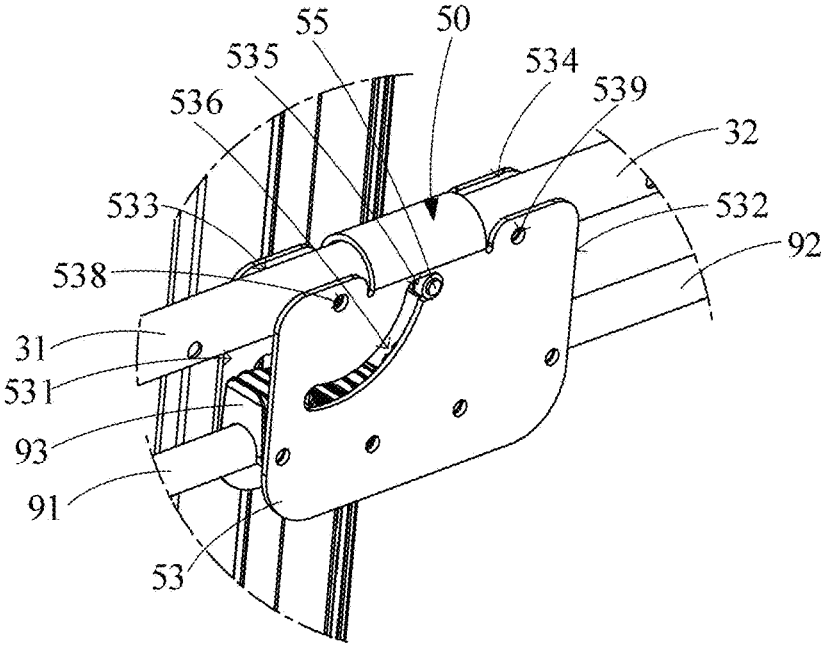
FIG. 12 is a partial enlarged view of part D in FIG. 11.

In some embodiments, and with reference to FIGS. 11 and 12, the housing 53 is sleeved over the second end of the first rod 31 and the second end of the second rod 32. In this manner, the housing 53 can envelop the second ends of the first rod 31 and the second rod 32, enhancing the aesthetic appeal of the liftable and foldable crib during use and reducing the likelihood of scratches from the first rod 31 and the second rod 32.

There are various possibilities for the arrangement of the rotatable connection between the first rod 31, the second rod 32, and the housing 53.

For example, in some embodiments, and with reference to FIGS. 11 to 16, the housing 53 comprises a first connection hole 538, and the second end of the first rod 31 comprises a second connection hole 311. The latch 51 comprises a clearance hole 512. The clearance hole 512 is elongated in shape and extends along the lengthwise direction of the first rod 31. The first connection hole 538, the second connection hole 311, and the clearance hole 512 are in communication. A first rotary connecting member is disposed within the first connection hole 538, the second connection hole 311, and the clearance hole 512. In this configuration, when the first lock assembly 50 switches between the locked state and the unlocked state, the latch 51 moves along the lengthwise direction of the first rod 31. Because the clearance hole 512 in the latch 51 is elongated, this shape provides clearance for the first rotary connecting member during this movement.

Furthermore, the housing 53 is further provided with a third connection hole 539. The second end of the second rod 32 comprises a fourth connection hole, and the striker plate 52 comprises a fifth connection hole 521. The third connection hole 539, the fourth connection hole, and the fifth connection hole 521 are in communication. A second rotary connecting member is disposed within the third connection hole 539, the fourth connection hole, and the fifth connection hole 521.

Figure 14:
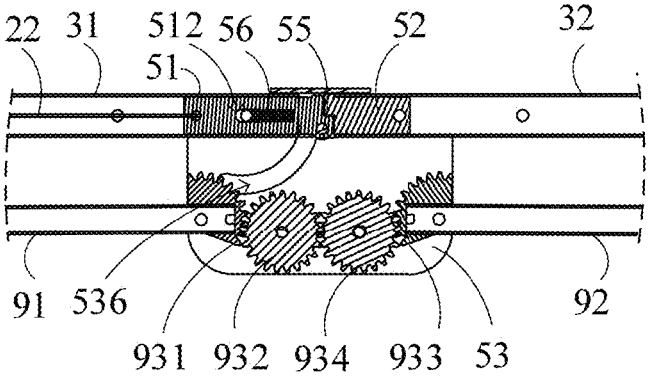
FIG. 14 is a partial enlarged view of part E in FIG. 13.

With reference to FIGS. 12 and 14, the housing 53 comprises a first positioning hole 535 and an arc-shaped hole 536 in communication with the first positioning hole 535. The first positioning hole 535 is positioned corresponding to a region between the first rod 31 and the second rod 32, and the arc-shaped hole 536 is positioned corresponding to the second end of the first rod 31.

Furthermore, the first lock assembly 50 further comprises a sliding member 55. The sliding member 55 is disposed on the latch 51. In the locked state, the sliding member 55 is located within the first positioning hole 535. The sliding member 55 is capable of moving within the arc-shaped hole 536 in a direction away from the first positioning hole 535, thereby switching the first lock assembly 50 from the locked state to the unlocked state. In the unlocked state, the sliding member 55 is located within the arc-shaped hole 536.

If it is desired to collapse the liftable and foldable crib, the first operating member 21 is flipped outward. The first operating member 21 then drives the latch 51, via the first traction member 22, to move away from the striker plate 52. Specifically, driven by the first traction member 22, the sliding member 55 slides from the first positioning hole 535 into the arc-shaped hole 536 and moves within the arc-shaped hole 536 away from the first positioning hole 535. In this way, as the sliding member 55 slides within the arc-shaped hole 536, it both switches the first lock assembly 50 from the locked state to the unlocked state and causes the second end of the first rod 31 to rotate downward.

If it is desired to unfold the liftable and foldable crib, the sliding member 55 moves within the arc-shaped hole 536 toward the first positioning hole 535 until the sliding member 55 slides into the first positioning hole 535. The wall of the first positioning hole 535 then serves to limit the sliding member 55, causing the latch 51 to become fixed relative to the housing 53, while the striker plate 52 engages with the latch 51. In this manner, the guardrail assembly 30 is fixed relative to the side frame 10.

Additionally, the cooperation between the arc-shaped hole 536 and the sliding member 55 provides guidance for the movement of the sliding member 55, enhancing its stability and ensuring smooth unfolding and collapsing of the liftable and foldable crib.

Furthermore, with reference to FIG. 12, the arc-shaped hole 536 is centered on the first connection hole 538. In this manner, the first rod 31 rotates about the center of the first connection hole 538, preventing the arc-shaped hole 536 from interfering with the rotation of the first rod 31 and ensuring the smooth rotation thereof.

Figure 13:
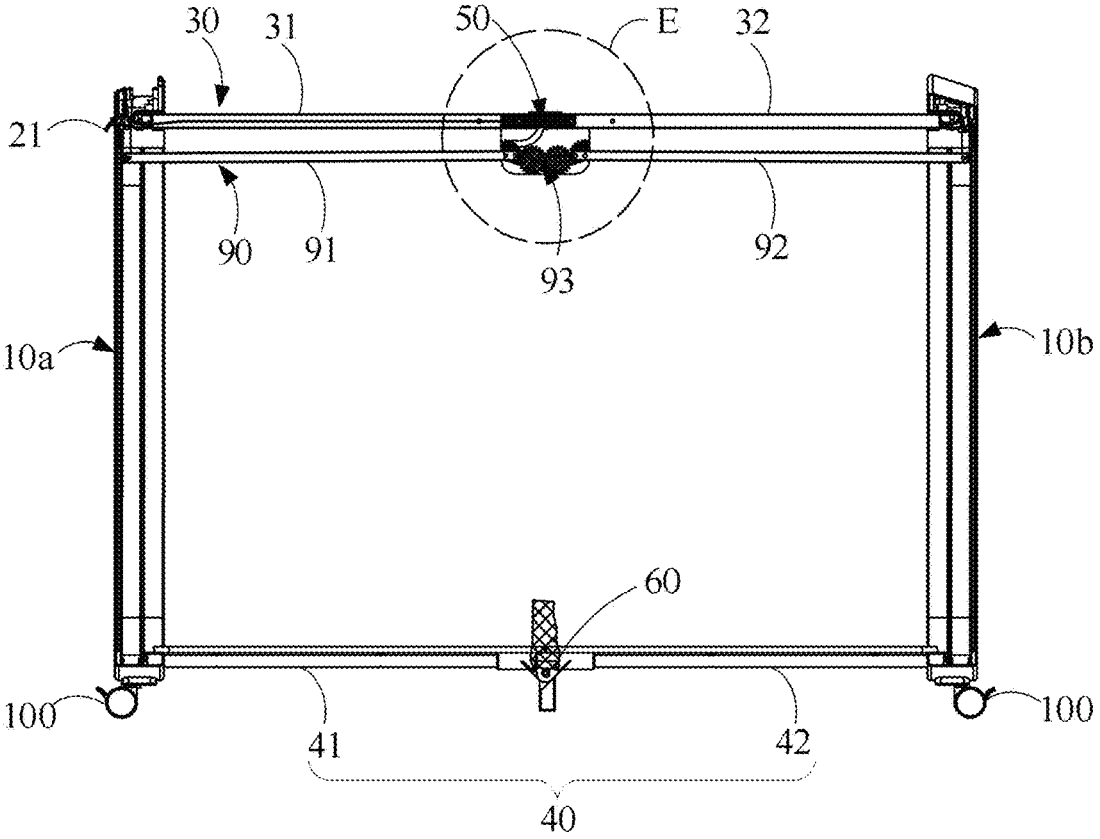
FIG. 13 is a front view of the liftable and foldable crib shown in FIG. 11.

With reference to FIGS. 13 and 14, the first lock assembly 50 further comprises a second elastic reset member 56. The second elastic reset member 56 is connected to the latch 51 and the first rod 31, and is disposed to expand and contract along the lengthwise direction of the first rod 31. The second elastic reset member 56 is configured to drive the latch 51 to move toward the striker plate 52.

Figure 15:
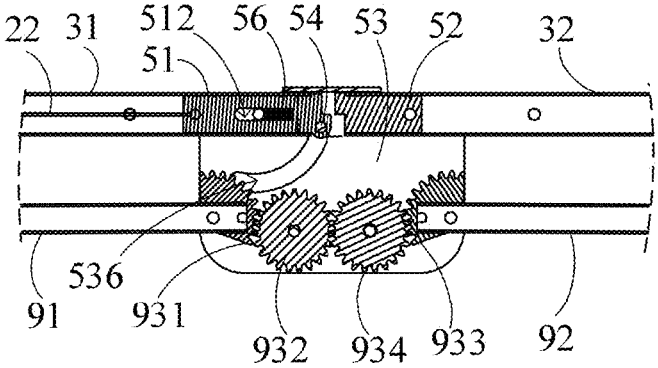
FIG. 15 is a schematic diagram showing the latch and the striker plate of the first lock assembly of the liftable and foldable crib in FIG. 14 in a separated state.

With reference to FIG. 15, during an unlocking operation, when the first operating member 21 is flipped outward, the first operating member 21 drives the latch 51, via the first traction member 22, to move away from the striker plate 52, and the second elastic reset member 56 is gradually compressed.

It is understandable that after the external force acting on the first operating member 21 is removed, the second elastic reset member 56 gradually extends its original position. Under the restoring force of the second elastic reset member 56, the latch 51 extends outward from the first rod 31.

Optionally, the second elastic reset member 56 is a spring, an elastic post, or the like, and is not limited thereto.

Figure 16:
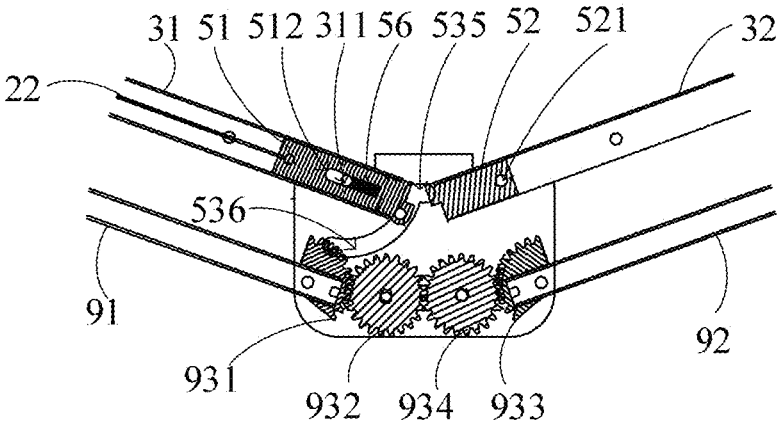
FIG. 16 is a schematic diagram showing the first rod and the second rod rotating relative to each other with the first lock assembly in an unlocked state.

With reference to FIGS. 15 and 16, when the first traction member 22 drives the latch 51 to move away from the striker plate 52 until the latch 51 and the striker plate 52 separate from each other, the first lock assembly 50 transitions from the locked state to the unlocked state. Consequently, the first rod 31 and the second rod 32 are able to rotate relative to the housing 53.

It should be noted that when the first lock assembly 50 and the second lock assembly 60 are in the unlocked state, the liftable and foldable crib may achieve collapsing under the gravitational force of some of its own structures, or through an inwardly directed squeezing force applied by a user to the side frames 10.

Figure 17:
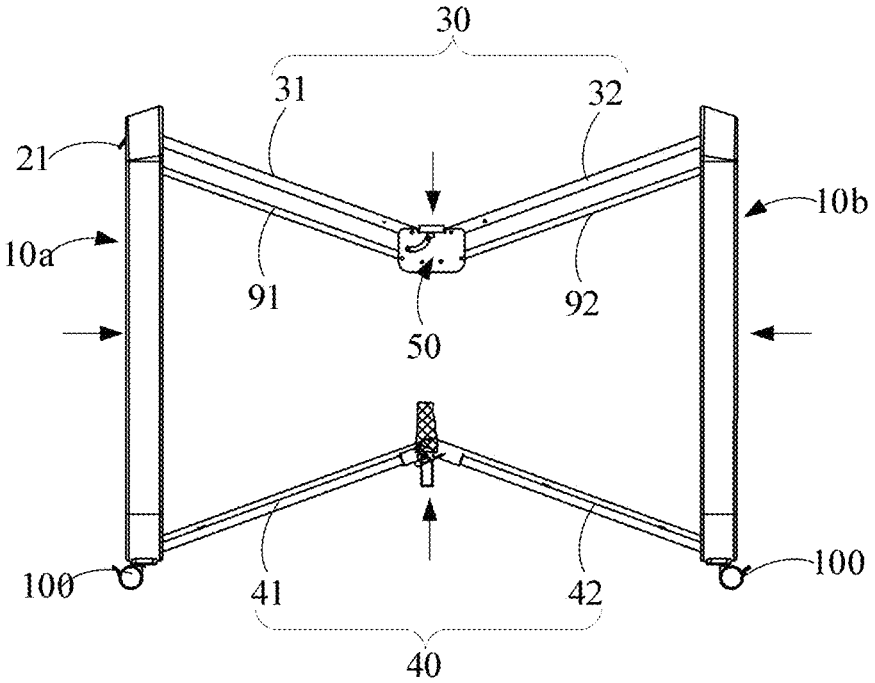
FIG. 17 is a schematic diagram showing the liftable and foldable crib of FIG. 11 progressively folding and collapsing.

For example, with reference to FIG. 17, after the first lock assembly 50 and the second lock assembly 60 are unlocked, the second ends of the first rod 31 and the second rod 32 rotate downward under their own gravitational force. This causes the first ends of the first rod 31 and the second rod 32 to move toward each other. Simultaneously, the second ends of the third rod 41 and the fourth rod 42 pivot upward at the location of the folding joint 43, causing the first ends of the third rod 41 and the fourth rod 42 to move toward each other. As a result, during the collapsing process, the first side frame 10*a* and the second side frame 10*b* move closer together. In this manner, the entire liftable and foldable crib can be collapsed, which is beneficial for reducing its overall volume and the space required for storage. Furthermore, this can simplify the collapsing steps and improve the efficiency of the collapsing operation.

Figure 18:
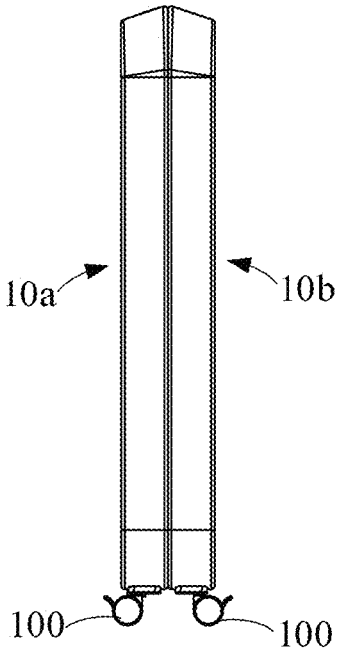
FIG. 18 is a schematic diagram of the liftable and foldable crib of FIG. 17 after being fully collapsed.

With reference to FIG. 18, when the liftable and foldable crib is fully collapsed, the first side frame 10*a* and the second side frame 10*b* contact each other.

In some embodiments, one or more elastic members may be provided to supply motive force for collapsing the liftable and foldable crib, thereby making the collapsing operation easier. The provision of such elastic member(s) can take various forms, provided that the elastic force can supply impetus for the collapsing of the guardrail assembly 30 or the support assembly 40 after the first lock assembly 50 and the second lock assembly 60 are unlocked.

For example, with reference to FIG. 11, in some embodiments, the first lock assembly 50 further comprises a first folding elastic member 57. One end of the first folding elastic member 57 is connected to the housing 53, and the other end is connected to the first rod 31 and/or the second rod 32. After the first lock assembly 50 is unlocked, the first folding elastic member 57 is configured to drive the second end of the first rod 31 and/or the second rod 32 to rotate downward. In this manner, by utilizing both the gravitational force of the first rod 31 and the second rod 32 and the elastic force of the first folding elastic member 57, the guardrail assembly 30 can be collapsed rapidly, thereby improving collapsing efficiency.

Optionally, one first folding elastic member 57 is provided. One end of the first folding elastic member 57 is connected to the housing 53, and the other end is connected to the first rod 31. Alternatively, one end of the first folding elastic member 57 is connected to the housing 53, and the other end is connected to the second rod 32. This configuration can prevent the first folding elastic member 57 from causing motion interference with the sliding member 55.

Optionally, two first folding elastic members 57 are provided. One of the first folding elastic members 57 has its two ends connected to the first rod 31 and the housing 53 respectively, and the other first folding elastic member 57 has its two ends connected to the second rod 32 and the housing 53, respectively. This configuration can further improve the collapsing efficiency.

As another example, with reference to FIGS. 1 and 2, the liftable and foldable crib comprises a second folding elastic member 70. After the first lock assembly 50 and the second lock assembly 60 are unlocked, the second folding elastic member 70 is configured to urge the third rod 41 to rotate relative to the first side frame 10*a*, thereby increasing the collapsing efficiency.

The second folding elastic member 70 includes, but is not limited to, structures such as a spring or an elastic cord.

Referring again to FIG. 11, the liftable and foldable crib further comprises a mattress 80. The mattress 80 is disposed on the support assembly 40. During use, an infant or toddler is placed on the mattress 80, and the mattress 80 provides support.

Optionally, and with reference to FIG. 11, the mattress 80 comprises a first pad body 81 and a second pad body 82.

Both the first pad body 81 and the second pad body 82 may be rigid pad bodies. The first pad body 81 is disposed between the first side frame 10*a* and the folding joint 43. The second pad body 82 is disposed between the second side frame 10*b* and the folding joint 43. The first pad body 81 and the second pad body 82 are foldably connected.

Optionally, the first pad body 81 is connected to the second pad body 82 via a flexible fabric. In this manner, when the liftable and foldable crib is collapsed, there is no need to disassemble the mattress 80. This allows the mattress 80 to be collapsed together with the crib frame, simplifying the unfolding and collapsing steps of the liftable and foldable crib and improving its unfolding and collapsing efficiency.

In some embodiments, and with reference to FIG. 2, the mattress 80 comprises a first pad body 81, a second pad body 82, and a third pad body 83.

The first pad body 81, the second pad body 82, and the third pad body 83 are all rigid pad bodies. The first pad body 81 is disposed between the first side frame 10*a* and the folding joint 43. The second pad body 82 is disposed between the second side frame 10*b* and the folding joint 43. The third pad body 83 is positioned corresponding to the folding joint 43. The first pad body 81 is connected to the third pad body 83 via a flexible fabric, and the second pad body 82 is connected to the third pad body 83 via a flexible fabric. In this manner, when the liftable and foldable crib is collapsed, there is no need to disassemble the mattress 80. This allows the mattress 80 to be collapsed together with the crib frame, simplifying the unfolding and collapsing steps of the liftable and foldable crib and improving its unfolding and collapsing efficiency.

In some embodiments, one end of the guardrail assembly 30 is movably connected to the first side frame 10*a*, and the other end is movably connected to the second side frame 10*b*. The guardrail assembly 30 is capable of moving along the height direction of the first side frame 10*a* and the second side frame 10*b*, thereby achieving height adjustment of the guardrail assembly 30. During use, the guardrail assembly 30 can be pulled downward, facilitating placement of an infant or toddler into the liftable and foldable crib and also easing removal of the infant or toddler from the crib. When the crib is placed beside an adult, lowering the guardrail assembly 30 allows the adult to care for the infant or toddler without getting out of bed. Furthermore, under normal circumstances, the guardrail assembly 30 can be lifted upward to ensure the safety of the infant or toddler.

One end of the support assembly 40 is movably connected to the first side frame 10*a*, and the other end is movably connected to the second side frame 10*b*. During use, the support assembly 40 is capable of moving along the height direction of the first side frame 10*a* and the second side frame 10*b*, thereby achieving height adjustment of the support assembly 40.

In some embodiments, both the first side frame 10*a* and the second side frame 10*b* are capable of extending and contracting along their lengthwise directions. Specifically, the first support member 11 and the second support member 12 are telescopic rods. The first support member 11 can extend and contract along its lengthwise direction, and the second support member 12 can extend and contract along its lengthwise direction. After the liftable and foldable crib is folded and collapsed, the first support member 11 and the second support member 12 can be contracted to reduce the height of the crib. This reduces the packaging and transportation space without disassembling the crib, thereby lowering transportation costs.

It should be noted that the liftable and foldable crib may adopt leg-type support on the ground or wheel-type support on the ground.

With reference to FIG. 13, in some embodiments, the liftable and foldable crib further comprises a synchronization mechanism 90. One end of the synchronization mechanism 90 is rotatably connected to the first side frame 10*a*, and the other end is rotatably connected to the second side frame 10*b*. In this manner, and taking FIG. 4 as an example, the left-side structure and the right-side structure of the first lock assembly 50 can maintain synchronization and consistency during unfolding and collapsing.

Furthermore, with reference to FIGS. 13 to 15, the synchronization mechanism 90 comprises a fifth rod 91, a synchronous gear set 93, and a sixth rod 92. A first end of the fifth rod 91 is rotatably connected to the first side frame 10*a*, and a first end of the sixth rod 92 is rotatably connected to the second side frame 10*b*. The synchronous gear set 93 is rotatably disposed within the housing 53 and is positioned at a second end of the fifth rod 91 and a second end of the sixth rod 92. In this configuration, the synchronous gear set 93 possesses rotational freedom, enabling smooth rotation. During the unfolding and collapsing of the guardrail assembly 30 and the support assembly 40, the synchronous gear set 93 serves to maintain synchronization, preventing asynchronous movement that could adversely affect the unfolding and collapsing process.

Figure 19:
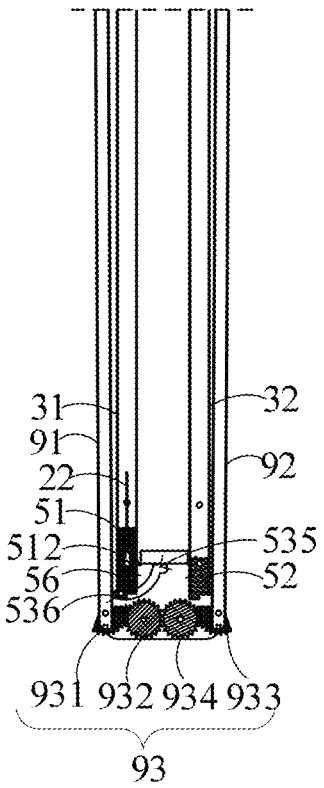
FIG. 19 is a schematic diagram of the liftable and foldable crib in a folded state, with the axes of the first rod and the second rod in a plane.

Optionally, with reference to FIGS. 16 and 19, the synchronous gear set 93 comprises a first fixed gear 931, a first movable gear 932, a second fixed gear 933, and a second movable gear 934. The first fixed gear 931 is disposed at the second end of the fifth rod 91. The second fixed gear 933 is disposed at the second end of the sixth rod 92. The first movable gear 932 and the second movable gear 934 are positioned between the first fixed gear 931 and the second fixed gear 933 and are rotatably connected to the housing 53. The first fixed gear 931 meshes with the first movable gear 932, the first movable gear 932 meshes with the second movable gear 934, and the second movable gear 934 meshes with the second fixed gear 933.

Optionally, in another embodiment, the synchronous gear set 93 may also be a synchronous belt pulley, and is not limited thereto.

Furthermore, with reference to FIGS. 20 to 24, the crib further comprises a third lock assembly. The third lock assembly is detachably connected and disposed on the reinforcement member 14. The reinforcement member 14 comprises a second positioning hole 141. The third lock assembly comprises a second operating member 16, a third traction member 17, a pulling member 18, and a first adjustment seat 19. A first end and a second end of the third traction member 17 are fixedly connected to the second operating member 16 and the pulling member 18, respectively. The pulling member 18 comprises a third guide groove 181 and a positioning portion 182. The second operating member 16 comprises a first housing 161, a second housing 162, and a limit box 163. The limit box 163 comprises a third positioning hole 1631. The first end of the third traction member 17 is fixed in the second positioning hole 141 and is slidable along the third positioning hole 1631. The second end of the third traction member 17 is fixed in the third guide groove 181. The second support member 12 comprises a plurality of fourth positioning holes 121. When it is necessary to adjust the height of the support assembly 40, the limit box 163 is operated to cause the first end of the third traction member 17 to move along the third positioning hole 1631, thereby driving the positioning portion 182 to disengage from one of the fourth positioning holes 121. At this time, the first adjustment seat 19 can slide freely along a lengthwise direction of the second support member 12, thereby achieving height adjustment of the support assembly 40. After the support assembly 40 is adjusted to a predetermined height, the limit box 163 is released, allowing the positioning portion 182 to extend into a corresponding fourth positioning hole 121 to complete locking.

Optionally, each of the first side frame 10*a* and the second side frame 10*b* further comprises a reinforcement rod 142, both ends of the reinforcement rod 142 being connected to a lower portion of the first support member 11 and a lower portion of the second support member 12, respectively. When the reinforcement member 14 freely slides along the longitudinal direction of the second support member 12 together with the support assembly 40, the reinforcement rod 142 maintains stability of the first side frame 10*a* and the second side frame 10*b*.

Optionally, the second operating member 16 further comprises a third elastic reset member. The pulling member 18 is further provided with a fourth guide groove 183, and a fourth elastic reset member is disposed within the fourth guide groove 183. After the height adjustment of the support assembly 40 is completed, the third elastic reset member and the fourth elastic reset member can respectively drive the second operating member 16 and the pulling member 18 to elastically reset to its original positions.

Furthermore, with reference to FIGS. 20-22 and FIGS. 25-26, the crib further comprises a fourth lock assembly. The fourth lock assembly comprises a second adjustment seat 26, an elastic block 27, and a press member 28. The elastic block 27 comprises a pressing portion 271. The second adjustment seat 26 is slidably disposed on the second support member 12. The first rod 31 and the second rod 32 are fixedly connected to the second adjustment seat 26, respectively. The elastic block 27 and the press member 28 are fixedly disposed inside and outside the second adjustment seat 26, respectively. The pressing portion 271 protrudes out from the second support member 12 to be in opposing abutment with the press member 28. When the pressing portion 271 is pressed, the pressing portion 271 retracts into the interior of the second support member 12, and the second adjustment seat 26 drives the first rod 31 and the second rod 32 to slide along the second support member 12 to a desired fourth positioning hole 121 at a preset height. At this point, releasing the press member 28 allows the pressing portion 271 to extend out from the second support member 12, thereby fixing the second adjustment seat 26 at the corresponding position on the second support member 12.

Figure 20:
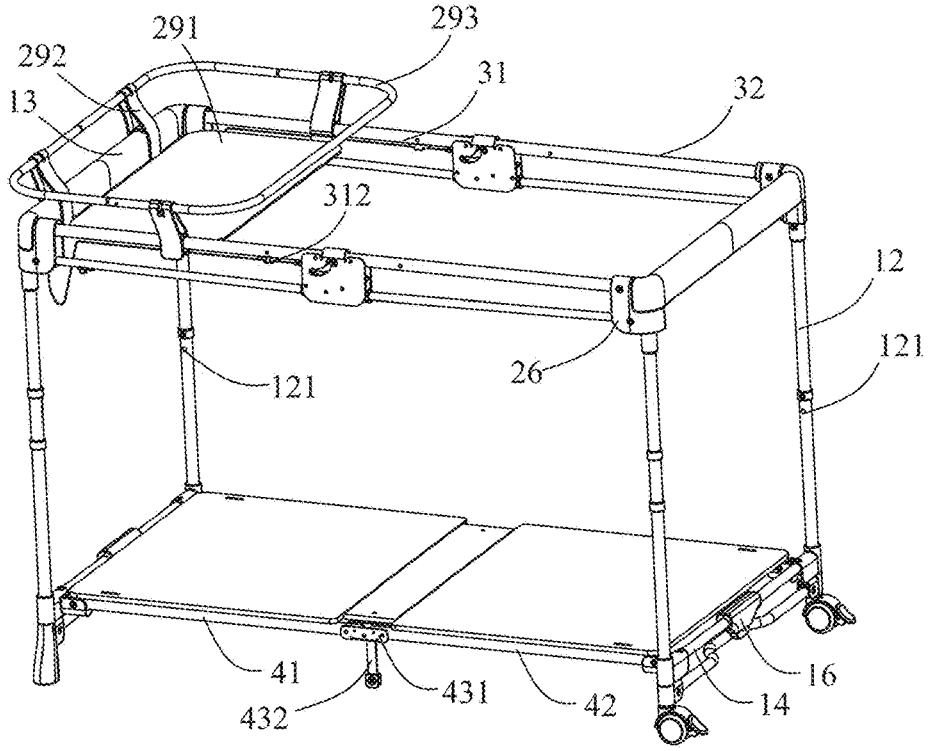
FIG. 20 is a schematic diagram of a liftable and foldable crib in an unfolded state according to another embodiment of the disclosure.
Figure 21:
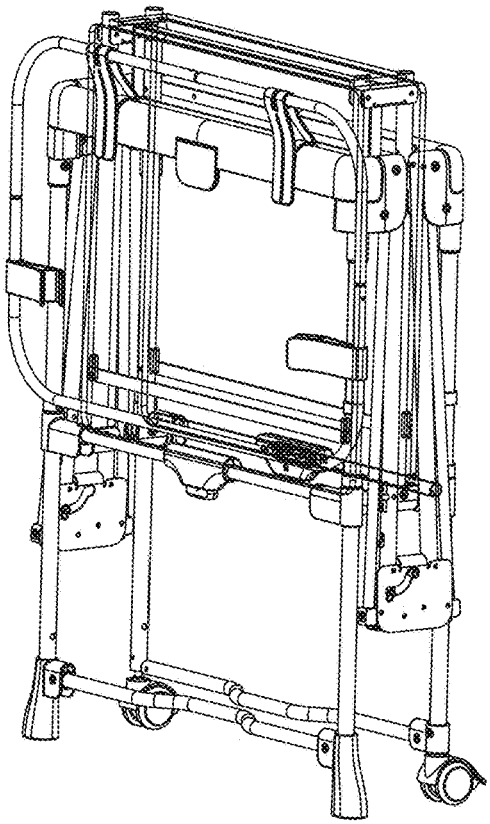
FIG. 21 is a perspective view of the liftable and foldable baby crib of FIG. 20 in a folded state.
Figure 22:
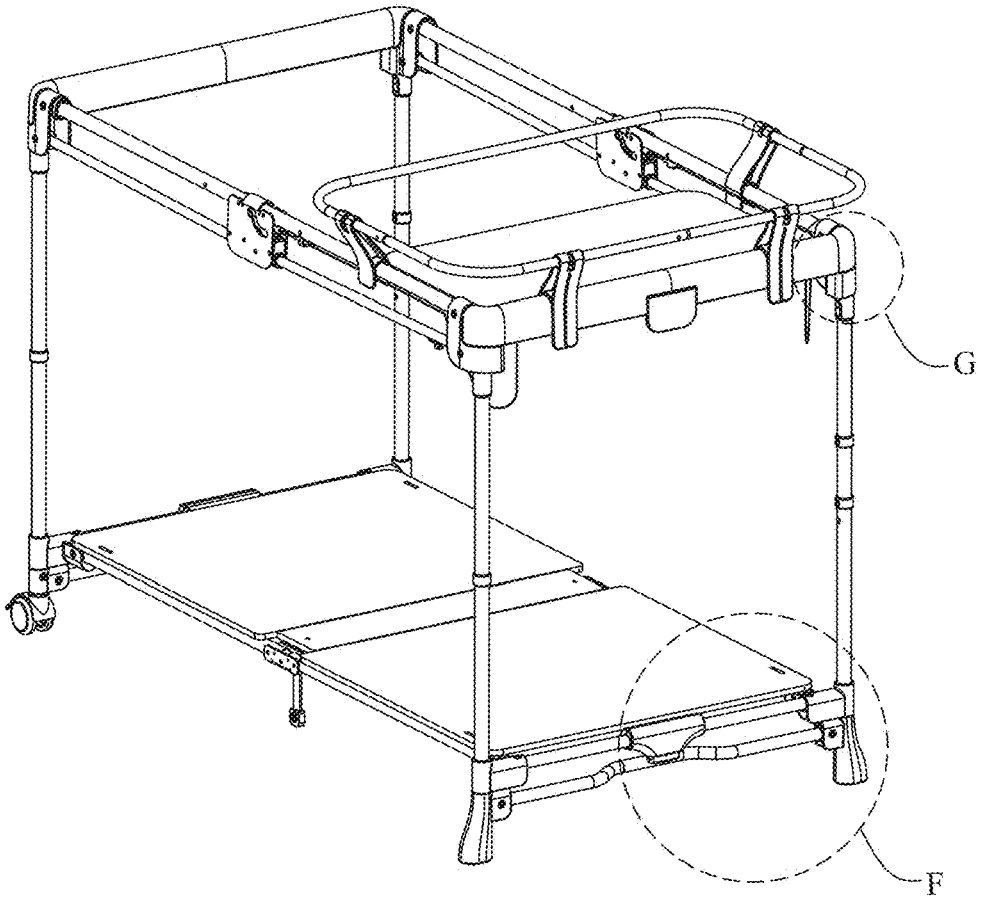
FIG. 22 is another perspective view of the liftable and foldable baby crib of FIG. 20 in an unfolded state.
Figure 23:
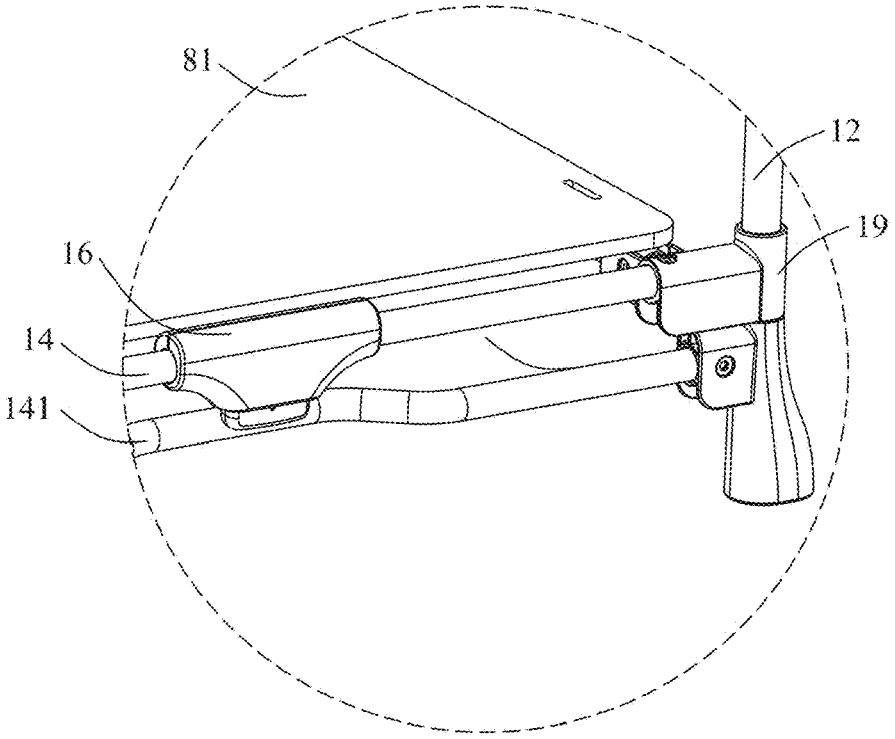
FIG. 23 is a partial enlarged view of part F in FIG. 22.
Figure 24:
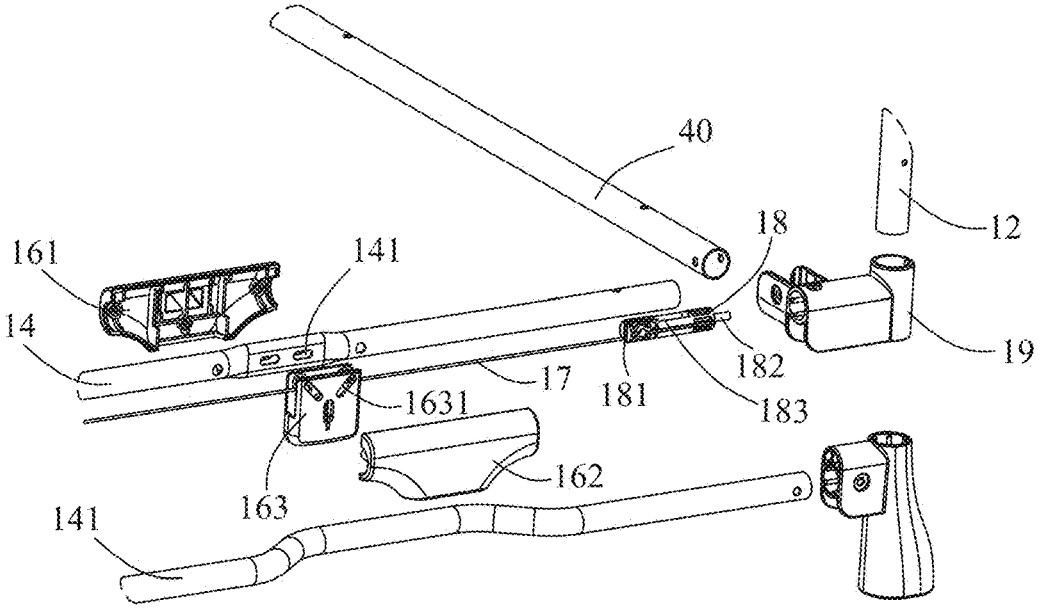
FIG. 24 is an exploded view of FIG. 23 with the first cushion body removed.
Figure 25:
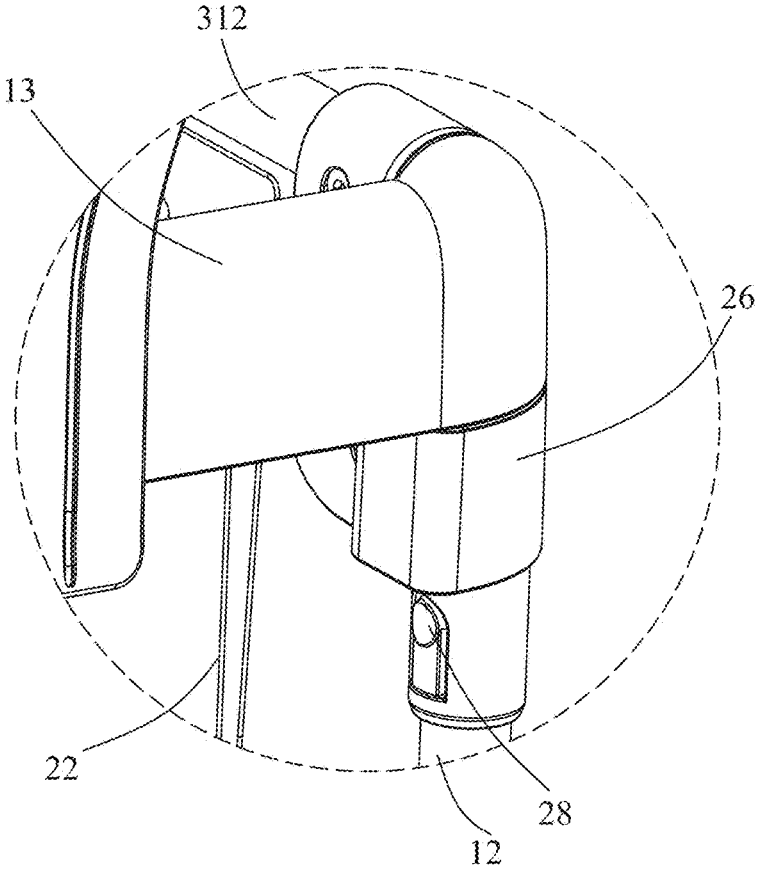
FIG. 25 is a partial enlarged view of part G in FIG. 22.
Figure 26:
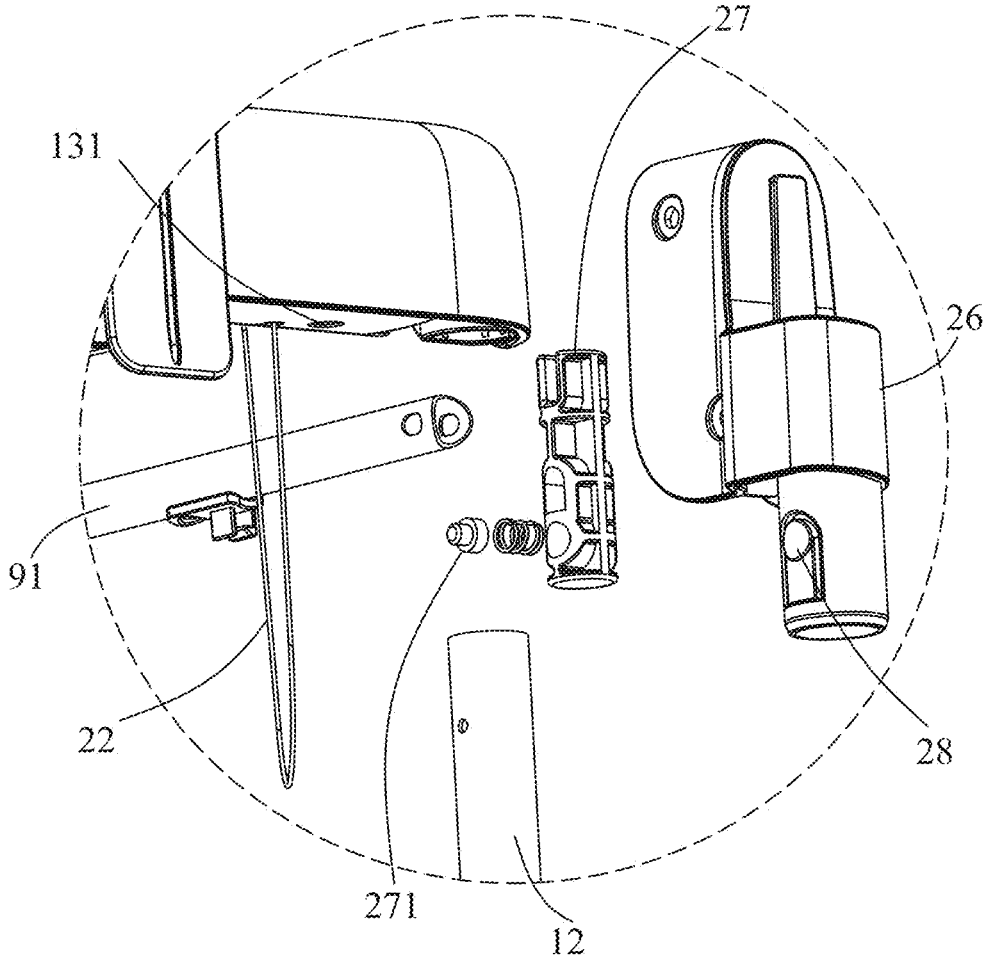
FIG. 26 is an exploded view of FIG. 25.

Optionally, as shown in FIG. 20, an outer side of the first rod 31 is further provided with a fixing base 312; the fixing base is configured to secure the first traction member 22 on an outer side of the guardrail 13; as shown in FIG. 20, the guardrail 13 comprises a through hole 131; after being led out from the through hole 131 of the guardrail 13, the first traction member 22 is fixedly connected to the latch 51 by the fixing base 312.

Optionally, the latch 52 is further provided with a receiving cavity and a fixing portion; the fixing portion extends out from the receiving cavity; the first traction member 22, after being led out from the guardrail 13, is connected to the fixing portion through the fixing base 312.

Optionally, as shown in FIG. 20, the folding joint 43 comprises a connecting tube 431 and a support base 432. The connecting tube 431 is fixedly connected to the support base 432. The second end of the third rod 41 and the second end of the fourth rod 42 are detachably connected to the connecting tube 431, respectively. When the support base is lifted upward, the second end of the third rod 41 and the second end of the fourth rod 42 respectively rotate relative to the connecting tube 431.

Optionally, with reference to FIG. 20, the crib may also be configured with a changing table. The changing table comprises a base plate 291, a plurality of connecting rods 292, a side guard 293, and an outer cover. Each connecting rod 292 comprises a through channel and a locking portion. The side guard 293 is fixed in the through channel. Each connecting rod 292 is detachably connected to the first rod 31 and the guardrail 13. The outer cover encloses the base plate 291, the plurality of connecting rods 292, and the side guard 293.

With reference to FIG. 11, a bottom of each of the first side frame 10*a* and the second side frame 10*b* is provided with a wheel 100. This facilitates the transfer of the liftable and foldable crib.

Furthermore, the wheel 100 comprises a brake. This allows the liftable and foldable crib to be stably stopped at a location of use. Optionally, the brake is controlled manually or by foot.

It will be obvious to those skilled in the art that changes and modifications may be made, and therefore, the aim in the appended claims is to cover all such changes and modifications.

What is claimed is:

1. A crib, comprising:

a side frame comprising a first side frame and a second side frame, wherein the first side frame and the second side frame are disposed opposite to and spaced apart from each other;

a guardrail assembly disposed between the first side frame and the second side frame, the guardrail assembly comprising a first rod and a second rod, wherein a first end of the first rod is rotatably connected to the first side frame, and a first end of the second rod is rotatably connected to the second side frame;

a support assembly disposed between the first side frame and the second side frame, the support assembly comprising a third rod, a fourth rod, and a folding joint, wherein a first end of the third rod is rotatably connected to the first side frame, a first end of the fourth rod is rotatably connected to the second side frame, and a second end of the third rod and a second end of the fourth rod are rotatably connected via the folding joint;

a first lock assembly disposed between the first rod and the second rod, and configured to restrict relative rotation between the first rod and the second rod in an unfolded state of the crib;

a second lock assembly configured to restrict relative rotation between the third rod and the fourth rod in the unfolded state of the crib; and a linkage unlocking mechanism comprising: a first operating member movably connected to the first side frame and movable relative thereto between a locked position and an unlocking position; a first traction member operatively connecting the first operating member to the first lock assembly; and a second traction member operatively connecting the first operating member to the second lock assembly; wherein the first operating member, the first traction member, and the second traction member are configured such that movement of the first operating member to the unlocking position causes the first traction member and the second traction member to concurrently disengage the first lock assembly and the second lock assembly, respectively.

2. The crib of claim 1, wherein the first operating member is pivotally disposed on the first side frame; the linkage unlocking mechanism further comprises a first elastic reset member, the first elastic reset member is connected to both the first operating member and the first side frame, and the first elastic reset member is configured to reset the first operating member to the locked position.

3. The crib of claim 2, wherein upon disengagement of the first lock assembly and the second lock assembly, second ends of the first rod and the second rod are configured to rotate toward the support assembly while first ends thereof move toward each other; second ends of the third rod and the fourth rod are configured to rotate toward the guardrail assembly while first ends thereof move toward each other; and the first side frame and the second side frame are configured to move toward each other.

4. The crib of claim 1, wherein the first lock assembly comprises a latch, a striker plate, and a housing; the latch is movably disposed at the second end of the first rod; the striker plate is disposed at the second end of the second rod; an end of the first traction member distal from the first operating member is connected to the latch; the second end of the first rod and the second end of the second rod are both rotatably connected to the housing; when the first lock assembly is in a locked state, the striker plate is engaged with the latch and restricts the first rod and the second rod from rotating relative to the housing; when the first traction member drives the latch to move in a direction away from the striker plate, the latch separates from the striker plate, thereby allowing the first rod and the second rod to rotate relative to the housing.

5. The crib of claim 4, wherein the first lock assembly further comprises a first folding elastic member; one end of the first folding elastic member is connected to the housing, and the other end of the first folding elastic member is connected to the first rod and/or the second rod; after the first lock assembly is unlocked, the first folding elastic member is configured to drive the second end of the first rod and/or the second end of the second rod to rotate towards the support assembly.

6. The crib of claim 4, wherein the first lock assembly further comprises a second elastic reset member; the second elastic reset member is connected to the latch and the first rod, and is configured to expand and contract along a lengthwise direction of the first rod; and an expansion of the second elastic reset member is configured to drive the latch to move towards the striker plate.

7. The crib of claim 1, wherein:

the guardrail assembly or the support assembly comprises a reinforcement member; an end of the reinforcement member is connected to a mounting seat; the third rod is rotatably connected to the mounting seat;

the second lock assembly comprises a locking member, a third elastic reset member, and a transmission assembly; the locking member is movably connected to the mounting seat; in the unfolded state of the crib, the locking member extends into the third rod under an elastic force of the third elastic reset member to restrict the third rod from rotating relative to the mounting seat; the transmission assembly is configured to, under being driven by the second traction member, move the locking member in a direction away from the third rod, thereby causing the locking member to overcome the elastic force of the third elastic reset member and move out of the third rod.

8. The crib of claim 7, wherein:

the reinforcement member is a hollow tube body comprising a tube wall and a first guide groove formed in one end of the tube wall, the first guide groove extending in a direction parallel to a movement direction of the locking member;

the transmission assembly comprises a first transmission member and a second transmission member; the first transmission member comprises a guide hole and a second guide groove penetrating a side wall of the guide hole; an end of the locking member distal from the third rod is slidably fitted within the guide hole, and the locking member comprises a guide pin; the guide pin is inserted through the first guide groove and the second guide groove; a lengthwise direction of the second guide groove intersects with a lengthwise direction of the first guide groove; the first transmission member is telescopically disposed within the reinforcement member, such that a wall of the second guide groove is driven to push the guide pin to move along the first guide groove; the movement of the guide pin along the first guide groove drives the locking member to move out of the third rod.

9. The crib of claim 8, wherein the second transmission member is connected to the second traction member and, under being driven by the second traction member, is movable upward relative to the mounting seat in a vertical direction; a side of the second transmission member facing the first transmission member comprises an inclined surface; a portion of the first transmission member extends out from the reinforcement member and abuts against the inclined surface; when the second traction member drives the second transmission member to move relative to the mounting seat, the inclined surface pushes the first transmission member into the reinforcement member, thereby causing the first transmission member to drive the guide pin to move along the first guide groove in a direction away from the third rod.

10. The crib of claim 4, wherein the guardrail further comprises a through hole, the first traction member is led out from the through hole and connected to the latch.

11. The crib of claim 6, wherein:

the crib further comprises a third lock assembly detachably connected to the reinforcement member;

the reinforcement member comprises a second positioning hole;

the third lock assembly comprises a second operating member, a third traction member, a pulling member, and a first adjustment seat;

a first end and a second end of the third traction member are fixedly connected to the second operating member and the pulling member, respectively;

the pulling member comprises a third guide groove and a positioning portion;

the second operating member comprises a first housing, a second housing, and a limit box; the limit box comprises a third positioning hole;

the first end of the third traction member is fixed in the second positioning hole and is slidable along the third positioning hole; the second end of the third traction member is fixed in the third guide groove;

the second support member comprises a plurality of fourth positioning holes;

the second operating member is movable relative to the reinforcement member between a first position and a second position, and the pulling member is movable relative to the reinforcement member between a third position and a fourth position;

when the second operating member is in the first position, the pulling member is in the third position, and the positioning portion of the pulling member is disposed within one of the plurality of fourth positioning holes of the second support member, thereby locking the reinforcement member and the support assembly relative to the second support member; and when the second operating member is moved from the first position to the second position, the limit box of the second operating member causes the first end of the third traction member to move along the third positioning hole, such that the second end of the third traction member moves the pulling member from the third position to the fourth position, thereby disengaging the positioning portion of the pulling member from the one of the plurality of fourth positioning holes of the second support member and unlocking the reinforcement member and the support assembly relative to the second support member to permit a height adjustment of the support assembly.

12. The crib of claim 11, wherein the second operating member further comprises a third elastic reset member; the pulling member further comprises a fourth guide groove, and a fourth elastic reset member is disposed within the fourth guide groove; following the height adjustment of the support assembly, the third elastic reset member and the fourth elastic reset member are respectively configured to reset the second operating member to the first position and to reset the pulling member to the third positon.

13. The crib of claim 12, wherein the crib further comprises a fourth lock assembly; the fourth lock assembly comprises a second adjustment seat, an elastic block, and a press member; the elastic block comprises a pressing portion; the second adjustment seat is slidably disposed on the second support member; the first rod and the second rod are fixedly connected to the second adjustment seat; the elastic block and the press member are fixedly disposed inside and outside the second adjustment seat, respectively; and the pressing portion protrudes out from the second support member to be in opposing abutment with the press member.

14. The crib of claim 13, wherein an outer side of the first rod comprise a fixing base; the fixing base is configured to secure the first traction member on an outer side of the guardrail; after being led out from the guardrail, the first traction member is fixedly connected to the latch by the fixing base.

15. The crib of claim 14, wherein the latch is further provided with a receiving cavity and a fixing portion extending from the receiving cavity; the first traction member extends from the guardrail and is connected to the fixing portion through the fixing base.

16. The crib of claim 15, wherein the folding joint comprises a connecting tube and a support base; the connecting tube is fixedly connected to the support base; the third rod and the fourth rod are detachably connected to the connecting tube; and the third rod and the fourth rod are configured to rotate relative to the connecting tube in response to the support base being lifted.

17. The crib of claim 16, further comprising a changing table; wherein the changing table comprises a base plate, a plurality of connecting rods, a side guard, and an outer cover; each of the connecting rods comprises a through channel and a locking portion; the side guard is fixed within the through channel; the locking portion of each connecting rod is detachably connected to the first rod and the guardrail; and the outer cover encloses the base plate, the plurality of connecting rods, and the side guard.

18. The crib of claim 1, wherein the crib further comprises a foldable mattress disposed on the support assembly; and the first side frame and the second side frame are each telescopically adjustable along a lengthwise direction of the foldable mattress.

* * * * *